US009202413B2

(12) United States Patent
Minami et al.

(10) Patent No.: US 9,202,413 B2
(45) Date of Patent: Dec. 1, 2015

(54) DRIVE METHOD OF DISPLAY DEVICE

(71) Applicant: Sony Corporation, Tokyo (JP)

(72) Inventors: Tetsuo Minami, Tokyo (JP); Katsuhide Uchino, Kanagawa (JP)

(73) Assignee: JOLED, Inc., Tokyo (JP)

( * ) Notice: Subject to any disclaimer, the term of this patent is extended or adjusted under 35 U.S.C. 154(b) by 0 days.

(21) Appl. No.: 14/529,374

(22) Filed: Oct. 31, 2014

(65) Prior Publication Data

US 2015/0054819 A1 Feb. 26, 2015

Related U.S. Application Data

(63) Continuation of application No. 12/662,924, filed on May 12, 2010, now abandoned.

(30) Foreign Application Priority Data

Jun. 3, 2009 (JP) ..... 2009-133606

(51) Int. Cl.
*G09G 3/30* (2006.01)
*G09G 3/32* (2006.01)

(52) U.S. Cl.
CPC ..... *G09G 3/3233* (2013.01); *G09G 3/3266* (2013.01); *G09G 2300/0426* (2013.01); *G09G 2300/0439* (2013.01); *G09G 2300/0819* (2013.01); *G09G 2300/0842* (2013.01); *G09G 2300/0866* (2013.01); *G09G 2310/0251* (2013.01); *G09G 2310/0256* (2013.01); *G09G 2310/0291* (2013.01); *G09G 2320/043* (2013.01); *G09G 2330/028* (2013.01)

(58) Field of Classification Search
CPC ..... G09G 3/30; G09G 2340/0435
USPC ..... 345/76–83; 315/169.3
See application file for complete search history.

(56) References Cited

U.S. PATENT DOCUMENTS

| | | | | |
|---|---|---|---|---|
| 2003/0048238 | A1 | 3/2003 | Tsuge et al. | |
| 2005/0206590 | A1 | 9/2005 | Sasaki et al. | |
| 2006/0170628 | A1 | 8/2006 | Yamashita et al. | |
| 2007/0268210 | A1 | 11/2007 | Uchino et al. | |
| 2008/0001545 | A1 | 1/2008 | Uchino et al. | |
| 2008/0030436 | A1 | 2/2008 | Iida et al. | |
| 2008/0218500 | A1 * | 9/2008 | Akai et al. | 345/205 |
| 2008/0238830 | A1 | 10/2008 | Iida et al. | |
| 2008/0238901 | A1 | 10/2008 | Taneda et al. | |
| 2009/0160743 | A1 | 6/2009 | Tomida et al. | |

FOREIGN PATENT DOCUMENTS

JP 2007-310311 A 11/2007

* cited by examiner

*Primary Examiner* — Amr Awad
*Assistant Examiner* — Aaron Midkiff
(74) *Attorney, Agent, or Firm* — Michael Best & Friedrich LLP

(57) ABSTRACT

A drive method of a display device includes the steps of: performing threshold voltage cancel processing at least once, which changes a potential of a second node of a display device toward a potential obtained by subtracting a threshold voltage of a drive transistor from a potential of a first node by applying a given drive voltage to one source/drain region of the drive transistor from a feeding line while maintaining the potential of the first node; and then, performing writing processing which applies a video signal to the first node from a data line through a write transistor, wherein the sum of lengths of periods in which the threshold voltage cancel processing is performed is so set as to be shorter as a frame frequency becomes higher.

11 Claims, 27 Drawing Sheets

[ EMBODIMENT]

[EMBODIMENT]

[EMBODIMENT]

[EMBODIMENT]

[EMBODIMENT]
FIG.5A [TP(2)-1]
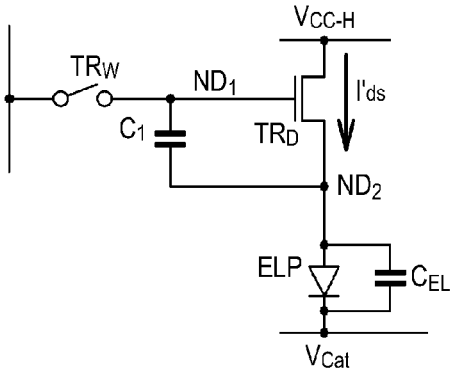
FIG.5B [TP(2)0]
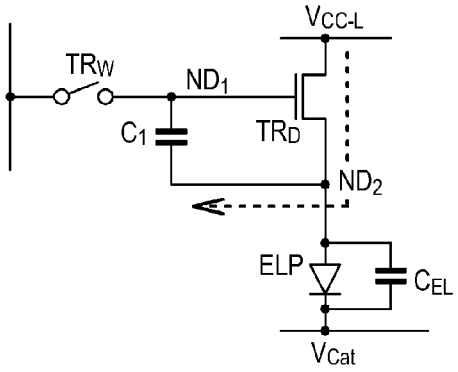
FIG.5C [TP(2)1A]
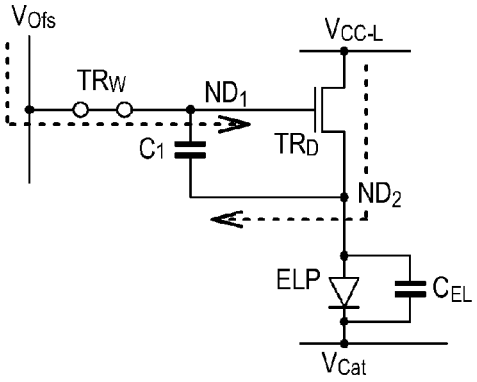
FIG.5D [TP(2)1B]
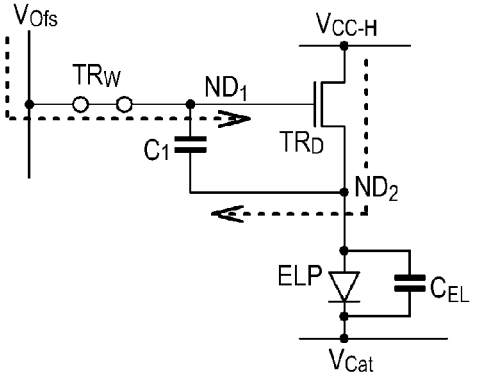
FIG.5E [TP(2)2]
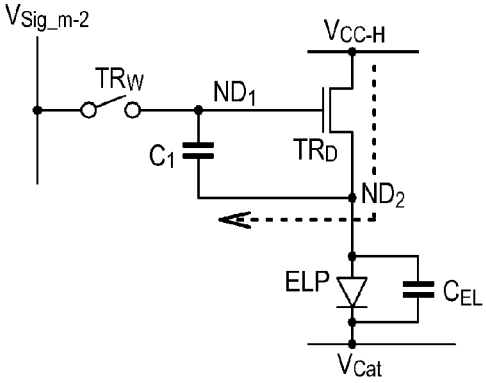
FIG.5F [TP(2)3]
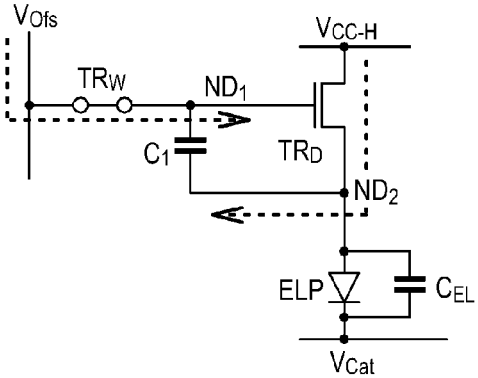

[EMBODIMENT]
FIG.6A [TP(2)4]
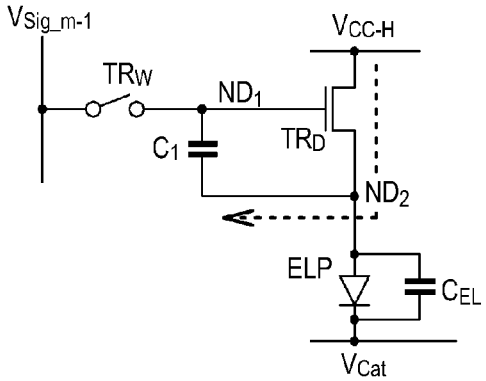
FIG.6B [TP(2)5]
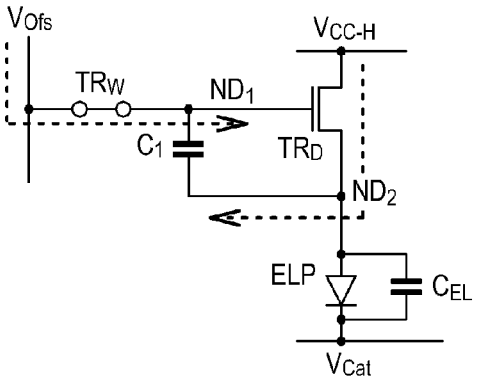
FIG.6C [TP(2)6A]
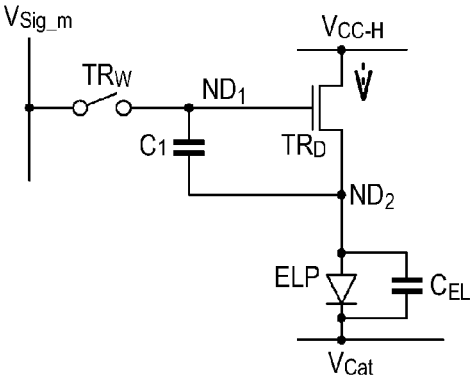
FIG.6D [TP(2)6B]
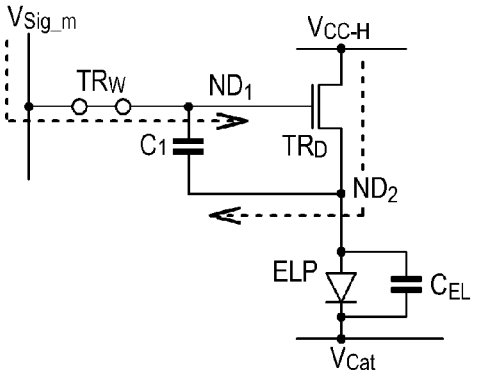
FIG.6E [TP(2)6c]
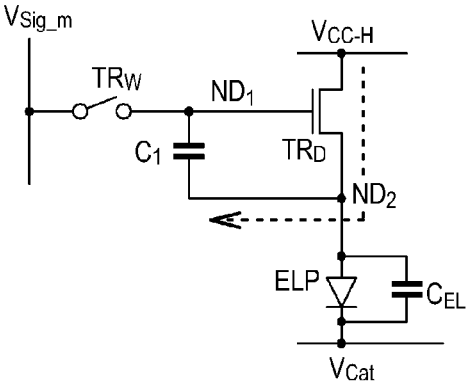
FIG.6F [TP(2)7]
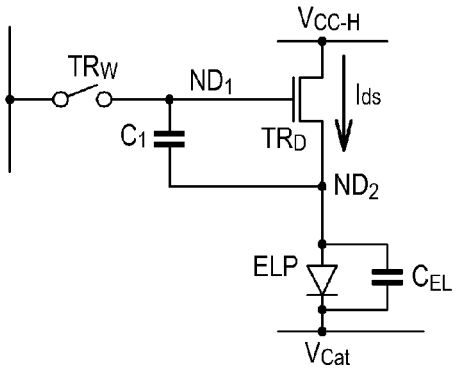

[EMBODIMENT]

[PERIOD A]

[PERIOD B]

[PERIOD C]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

[EMBODIMENT]

DRIVE METHOD OF DISPLAY DEVICE

CROSS REFERENCES TO RELATED APPLICATIONS

This is a Continuation application of U.S. patent application Ser. No. 12/662,924, filed on May 12, 2010, which claims priority from Japanese Patent Application No.: 2009-133606 filed with the Japanese Patent Office on Jun. 3, 2009, the entire contents of which being incorporated herein by reference.

BACKGROUND OF THE INVENTION

1. Field of the Invention

The present invention relates to a drive method of a display device.

2. Description of the Related Art

A display element including a current-drive type light emitting portion and a display device including such display element are well known. For example, a display element including an organic electroluminescence light emitting portion (also referred to merely as an organic EL display element in the following description) using electroluminescence (also referred to as EL in the following description) as an organic material receives attention as a display device capable of emitting light with high luminance by low-voltage direct current drive.

For example, in a display device including the organic EL display element (also referred to merely as an organic EL display device), a passive matrix method and an active matrix method are known as drive methods in the same manner as a liquid crystal display device. The active matrix method has a disadvantage that the configuration becomes complicated, however, it has also an advantage that luminance of an image can be increased and the like. The organic EL display element driven by the active matrix method includes, in addition to a light emitting portion having an organic layer and the like including a light emitting layer, a drive circuit for driving the light emitting portion.

As a circuit for driving the organic electroluminescence light emitting portion (also referred to merely as a light emitting portion in the following description), a drive circuit including two transistors and one capacitor unit (referred to as a 2Tr/Ic drive circuit) is known from, for example, JP-A-2007-310311 (Patent Document 1). The 2Tr/Ic drive circuit includes two transistors of a write transistor $TR_W$ and a drive transistor $TR_D$, and further includes one capacitor unit $C_1$ as shown in FIG. 2. Here, the other source/drain region of the drive transistor $TR_D$ configures a second node $ND_2$ and a gate electrode of the drive transistor $TR_D$ configures a first node $ND_1$.

A cathode electrode of a light emitting portion ELP is connected to a second feeding line PS2. A voltage $V_{Cat}$ (for example, 0V) is applied to the second feeding line PS2.

As shown in a timing chart of FIG. 4, pre-processing for performing threshold voltage cancel processing is executed in [Period–TP(2)$_{1A}$]. That is, a first node initialization voltage $V_{0fs}$ (for example, 0V) is applied to the first node $ND_1$ from a data line DTL through the write transistor $TR_W$ which has been turned on by a scanning signal from a scanning line SCL. According to this, a potential of the first node $ND_1$ will be $V_{0fs}$. A second node initialization voltage $V_{CC-L}$ (for example, −10V) is applied to a second node $ND_2$ from a power supply unit 100 through the drive transistor $TR_D$. According to this, a potential of the second node $ND_2$ will be $V_{CC-L}$. A threshold voltage of the drive transistor $TR_D$ is represented as a voltage Vth (for example, 3V). The voltage difference between the gate electrode and the other source/drain region of the drive transistor $TR_D$ (also referred to as a source region for convenience in the following description) is more than Vth, and the drive transistor $TR_D$ is in on-state.

Next, threshold voltage cancel processing is performed over a period from [Period-TP(2)$_{1B}$] to [Period-TP(2)$_5$]. Specifically, first threshold voltage cancel processing is performed in [Period-TP(2)$_{1B}$]. Specifically, second threshold voltage cancel processing is performed in [Period-TP(2)$_3$], then, third threshold voltage cancel processing is performed in [Period-TP(2)$_5$].

In [Period-TP(2)$_{1B}$], a voltage of the power supply unit 100 is switched from the second node initialization voltage $V_{CC-L}$ to a drive voltage $V_{CC-H}$ (for example, 20V) while maintaining on-state of the write transistor $TR_W$. As a result, the potential of the second node $ND_2$ is changed toward a potential obtained by subtracting the threshold voltage Vth of the drive transistor $TR_D$ from the potential of the first node $ND_1$. That is, the potential of the second node $ND_2$ is increased.

When [Period-TP(2)$_{1B}$] is sufficiently long, the potential difference between the gate electrode and the other source/drain region of the drive transistor $TR_D$ reaches the threshold Vth, and the drive transistor $TR_D$ is turned off. That is, the potential of the second node $ND_2$ becomes close to $(V_{ofs}-V_{th})$ and finally becomes $(V_{ofs}-V_{th})$. However, in the example shown in FIG. 4, the length of [Period-TP(2)$_{1B}$] is not sufficient for changing the potential of the second node $ND_2$ sufficiently, and the potential of the second node $ND_2$ reaches a given potential $V_1$ satisfying the relation $V_{CC-L}<V_1<(V_{ofs}-V_{th})$ at the end of [Period-TP(2)$_{1B}$].

At the beginning of [Period-TP(2)$_2$], a voltage of the data line DTL is switched from the first node initialization voltage $V_{ofs}$ to a video signal $V_{Sig_m-2}$. The write transistor $TR_W$ is turned off by the signal from the scanning line SCL at the beginning of [Period-TP(2)$_2$] so that the video signal $V_{Sig_m-2}$ is not applied to the first node $ND_1$. As a result, the first node $ND_1$ becomes in a floating state.

As the drive voltage $V_{CC-H}$ is applied to one source/drain region of the drive transistor $TR_D$ from the power supply unit 100, the potential of the second node $ND_2$ is increased to a given potential $V_2$ from the potential $V_1$. On the other hand, the gate electrode of the drive transistor $TR_D$ is in the floating state and the capacitor unit $C_1$ exists, therefore, a bootstrap operation is generated at the gate electrode of the drive transistor $TR_D$. Accordingly, the potential of the first node $ND_1$ is increased in accordance with potential change of the second node $ND_2$.

At the beginning of [Period-TP(2)$_3$], the voltage of the data line DTL is switched from the video signal $V_{Sig_m-2}$ to the first node initialization voltage $V_{ofs}$. At the beginning of [Period-TP(2)$_3$], the write transistor $TR_W$ is turned on by the signal from the scanning line SCL. As a result, the potential of the first node $ND_1$ becomes $V_{ofs}$. The drive voltage $V_{CC-H}$ is applied to one source/drain region of the drive transistor $TR_D$ from the power supply unit 100. As a result, the potential of the second node $ND_2$ is changed toward a potential obtained by subtracting the threshold voltage $V_{th}$ of the drive transistor $TR_D$ from the potential of the first node $ND_1$. That is, the potential of the second node $ND_2$ is increased from the potential $V_2$ to a given potential $V_3$.

At the beginning of [Period-TP(2)$_4$], the voltage of the data line DTL is switched from the first node initialization voltage $V_{0fs}$ to a video signal $V_{Sig_m-1}$. At the beginning of [Period-TP(2)$_4$], the write transistor $TR_W$ is turned off by the signal from the scanning line SCL so that the video signal $V_{Sig_m-1}$ is not applied to the first node $ND_1$. As a result, the first node $ND_1$ becomes in the floating state.

The drive voltage $V_{CC-H}$ is applied to one source/drain region of the drive transistor $TR_D$ from the power supply unit 100, therefore, the potential of the second node $ND_2$ is increased from the potential $V_3$ to a given potential $V_4$. On the other hand, the gate electrode of the drive transistor $TR_D$ is in the floating state and there exists the capacitor unit $C_1$, therefore, the bootstrap operation is generated at the gate electrode of the drive transistor $TR_D$. Accordingly, the potential of the first node $ND_1$ is increased in accordance with potential change of the second node $ND_2$.

As a presupposition of an operation in [Period-TP(2)$_5$], it is necessary that the potential $V_4$ of the second node $ND_2$ is lower than $(V_{ofs}-V_{th})$ at the beginning of [Period-TP(2)$_5$]. The length from the beginning of [Period-TP(2)$_{1B}$] to the beginning of [Period-TP(2)$_5$] is so determined as to satisfy a condition of $V_4<(V_{ofs-L}-V_{th})$ The operation of [Period-TP(2)$_5$] is basically the same as the operation explained in [Period-TP(2)$_3$]. At the beginning of [Period-TP(2)$_5$], the voltage of the data line DTL is switched from the video signal $V_{Sig_m-1}$ to the first node initialization voltage $V_{0fs}$. At the beginning of [Period-TP(2)$_5$], the write transistor $TR_W$ is turned on by the signal from the scanning line SCL.

The first node $ND_1$ is in a state that the first node initialization voltage $V_{0fs}$ is applied from the data line DTL through the write transistor $TR_W$. The drive voltage $V_{CC-H}$ is applied to one source/drain region of the drive transistor $TR_D$ from the power supply unit 100. As in the same manner as explained in [Period-TP(2)$_3$], the potential of the second node $ND_2$ is changed toward a potential obtained by subtracting the threshold voltage $V_{th}$ of the drive transistor $TR_D$ from the potential of the first node $ND_1$. When a potential difference between the gate electrode and the other source/drain region of the drive transistor $TR_D$ reaches $V_{th}$, the drive transistor $TR_D$ is turned off. In this state, the potential of the second node $ND_2$ is almost $(V_{ofs}-V_{th})$.

After that, in [Period-TP(2)$_{6A}$], the write transistor $TR_W$ is turned off. Then, the voltage of the data line DTL is made to be a voltage corresponding to a video signal [Video signal (drive signal, luminance signal) $V_{Sig_m}$ for controlling luminance in the light emitting portion ELP.

Next, in [Period-TP(2)$_{6B}$], writing processing is performed. Specifically, the write transistor $TR_W$ is turned on by allowing the scanning line SCL to be high level. As a result, the potential of the first node $ND_1$ is increased to the video signal $V_{Sig_m}$.

In the above operation, the video signal $V_{Sig_m}$ is applied to the gate electrode of the drive transistor $TR_D$ in the state in which the drive voltage $V_{CC-H}$ is applied to one source/drain region of the drive transistor $TR_D$ from the power supply unit 100. Accordingly, as shown in FIG. 4, the potential of the second node $ND_2$ is increased in [Period-TP(2)$_{6B}$]. The increased amount ΔV of the potential (potential correction value) will be described later. When the potential of the gate electrode of the drive transistor $TR_D$ (first node $ND_1$) is $V_g$ and the potential of the other source/drain region (second node $ND_2$) thereof is $V_s$, a value of $V_g$ and a value of $V_s$ will be as follows when the increased amount ΔV of the potential of the second node $ND_2$ is not considered. A potential difference between the first node $ND_1$ and the second node $ND_2$, namely, a potential difference $V_{gs}$ between the gate electrode of the drive transistor $TR_D$ and the other source/drain region functioning as a source region can be represented by the following formula (A).

$$V_g=V_{Sig_m}$$

$$V_s\cong V_{ofs}-V_{th}$$

$$V_{gs}\cong V_{Sig_m}-(V_{ofs}-V_{th}) \quad \text{(A)}$$

That is, $V_{gs}$ obtained in the writing processing with respect to the drive transistor $TR_D$ depends only on the video signal $V_{Sig_m}$ for controlling the luminance in the light emitting portion ELP, the threshold voltage $V_{th}$ of the drive transistor $TR_D$ and the voltage $V_{ofs}$ for initializing the potential of the gate electrode of the drive transistor $TR_D$. Additionally, $V_{gs}$ has no relation to a threshold voltage $V_{th-EL}$ of the light emitting portion ELP.

Next, mobility correction processing will be briefly explained. In the above-described operation, mobility correction processing for changing the potential of the other source/drain region of the drive transistor $TR_D$ (namely, the potential of the second node $ND_2$) in accordance with characteristics (for example, the size of mobility μ) of the drive transistor $TR_D$ is performed together with the writing processing.

As described above, the video signal $V_{Sig_m}$ is applied to the gate electrode of the drive transistor $TR_D$ in the state in which the drive voltage $V_{CC-H}$ is applied to the one source/drain region of the drive transistor $TR_D$ from the power supply unit 100. Here, as shown in FIG. 4, the potential of the second node $ND_2$ is increased in [Period-TP(2)$_{6B}$]. As a result, when a value of the mobility μ of the drive transistor $TR_D$ is large, the increased amount ΔV of the potential (potential correction value) in the source region of the drive transistor $TR_D$ is increased. When the value of the mobility μ of the drive transistor $TR_D$ is small, the increased amount ΔV of the potential (potential correction value) in the source region of the drive transistor $TR_D$ is reduced. The potential difference $V_{gs}$ between the gate electrode and the source region of the drive transistor $TR_D$ is deformed from the formula (A) to the following formula (B).

$$V_{gs}\cong V_{Sig_m}-(V_{ofs}-V_{th})-\Delta V \quad \text{(B)}$$

According to the above operation, the threshold voltage cancel processing, the writing processing and the mobility correction processing are completed. Then, at the beginning of [Period-TP(2)$_{6C}$] after that, the first node $ND_1$ is allowed to be in the floating state by turning off the write transistor $TR_W$ based on the scanning signal from the scanning line SCL. One source/drain region (also referred to as a drain region for convenience in the following description) is in a state in which the drive voltage $V_{CC-H}$ is applied from the power supply unit 100. As the result of the above, the potential of the second node $ND_2$ is increased and a phenomenon similar to a so-called bootstrap circuit is generated at the gate electrode of the drive transistor $TR_D$, then, the potential of the first node $ND_D$ is increased. The potential difference Vgs between the gate electrode and the source region of the drive transistor $TR_D$ maintains the value of the formula (B). Electric current flowing through the light emitting portion ELP is a drain current $I_{ds}$ flowing from the drain region to the source region of the drive transistor $TR_D$. When the drive transistor $TR_D$ ideally operates in a saturation region, the drain current $I_{ds}$ can be represented by the following formula (C). The light emitting portion ELP emits light corresponding to a value of the drain current $I_{ds}$. A coefficient "k" will be described later.

$$\begin{aligned} Ids &= k\cdot\mu\cdot(V_{gs}=V_{th})^2 \\ &= k\cdot\mu\cdot(V_{Sig_m}-V_{ofs}-\Delta V)^2 \end{aligned} \quad \text{(C)}$$

According to the above formula (C), the drain current $I_{ds}$ is in proportion to the mobility μ. On the other hand, the larger the mobility μ of the drive transistor $TR_D$ is, the larger the potential correction value ΔV becomes as well as the smaller a value of $(V_{Sig_m}-V_{ofs}-\Delta V)^2$ in the formula (C) becomes. Accordingly, variations of the drain current $I_{ds}$ caused by variations the mobility μ of the drive transistor can be corrected.

Operations of the 2Tr/1C drive circuit the outline of which has been explained as the above will be explained later.

SUMMARY OF THE INVENTION

A frame frequency (frame rate) at the time of displaying video on a display device can take various values according to, for example, broadcasting systems. It is preferable to set the frame frequency to be high in order to reduce the residual image effect at the time of displaying moving pictures. Accordingly, it is desirable that the display device can display video so as to correspond to various frame frequencies. For example, a configuration in which a horizontal scanning period during which display elements of respective rows is set to a fixed length regardless of the frame frequency to display video so as to correspond to various frequencies. In this case, the operations performed during the period from [Period-TP $(\mathbf{2})_{1A}$] to [Period-TP$(\mathbf{2})_{6C}$] are performed under the same conditions regardless of the frame frequency. However, there occurs a problem that a phenomenon in which the value of a video signal at the time of black display varies according to the frame frequency is seen and it is necessary to adjust the value of the video signal according to the frame frequency.

Therefore, it is desirable to provide a drive method of a display device capable of displaying video in respective frequencies in good condition without adjusting the value of the display signal.

According to an embodiment of the invention, there is provided a drive method of a display device, which uses the display device including (1) the total N×M pieces of display elements in which N-pieces in a first direction and M-pieces in a second direction different from the first direction are arranged in a two-dimensional matrix state, each having a current-drive type light emitting portion and a drive circuit, (2) M-pieces of scanning lines extending in the first direction, (3) N-pieces of data lines extending in the second direction and (4) M-pieces of feeding lines extending in the first direction, in which the drive circuit includes a write transistor, a drive transistor and a capacitor unit, in the display element of the m-th row (m=1, 2 . . . , M) and the n-th column (n=1, 2 . . . , N)

in the drive transistor, (A-1) one source/drain region is connected to the m-th feeding line, (A-2) the other source/drain region is connected to one end of the light emitting portion as well as connected to one electrode of the capacitor unit, which configures a second node, and (A-3) a gate electrode is connected to the other source/drain region of the write transistor as well as connected to the other electrode of the capacitor unit, which configures a first node, in the write transistor, (B-1) one source/drain region is connected to the n-th data line, and (B-2) the gate electrode is connected to the m-th scanning line.

The drive method of the display device according to the embodiment of the invention includes the steps of (a) performing threshold voltage cancel processing at least once, which changes a potential of the second node toward a potential obtained by subtracting a threshold voltage of the drive transistor from a potential of the first node by applying a given drive voltage to one source/drain region of the drive transistor from the feeding line while maintaining the potential of the first node, then, (b) performing writing processing which applies a video signal to the first node from the data line through the write transistor, in which the sum of lengths of periods in which the threshold voltage cancel processing is performed is so set as to be shorter as a frame frequency becomes higher.

In the drive method of the display device according to the embodiments, the sum of lengths of periods during which the threshold voltage cancel processing is performed is so set to be shorter as the frame frequency becomes higher. Accordingly, potential difference between the first node and the second node before the step (b) is performed becomes larger as the frame frequency becomes higher. Additionally, potential difference between the first node and the second node after the writing processing also becomes larger as the frame frequency becomes higher, therefore a phenomenon in which the value of the video signal in so-called black display varies according to variations of the frame frequency can be cancelled. Accordingly, it is possible to display pictures in respective frequencies in good condition without adjusting the value of the video signal.

BRIEF DESCRIPTION OF THE DRAWINGS

FIGS. 5A to 5F are diagrams schematically showing an ON/OFF state and the like of respective transistors included in the drive circuit in the display element;

FIGS. 6A to 6F are diagrams schematically showing the ON/OFF state and the like of respective transistors included in the drive circuit in the display element continued from FIG. 5F;

DESCRIPTION OF THE PREFERRED EMBODIMENTS

Figure 1:
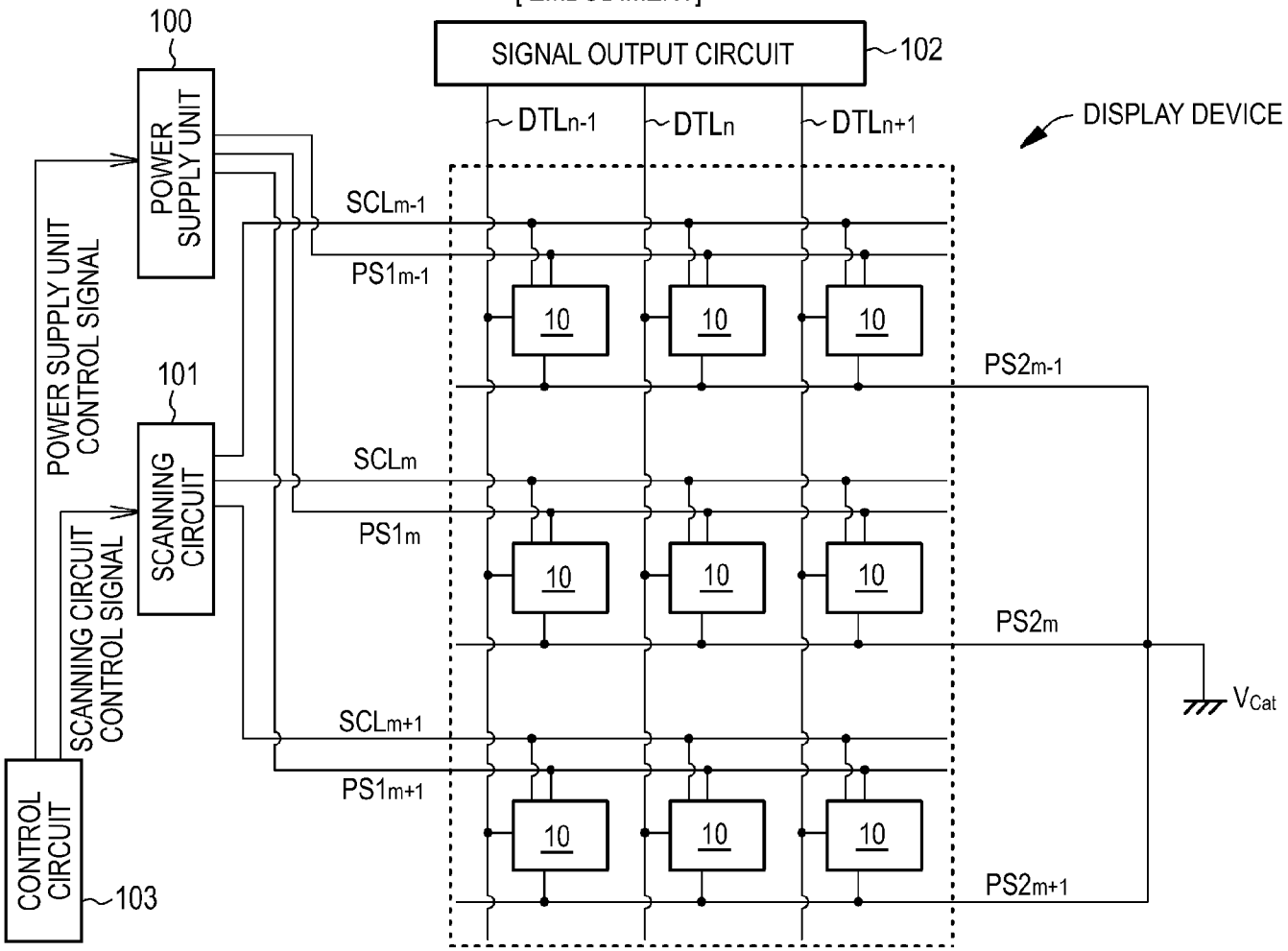
FIG. 1 is a conceptual diagram of a display device according to an embodiment.

Hereinafter, the invention will be explained based on an embodiment with reference to the drawings. The explanation will be performed in the following order.

1. Detailed explanation concerning a drive method of a display device according to an embodiment of the invention 2. Explanation of an outline of the display device used in the embodiment 3. Embodiment (Example of a 2Tr/1C drive circuit)

Detailed Explanation Concerning a Drive Method of a Display Device According to an Embodiment of the Invention In a display method of a display device according to an embodiment of the invention (also referred to as the embodiment of the invention in the following description), when the display device is driven by a given frame frequency FR in the step (a), it is possible to apply a configuration which satisfies $$TU(FR_1)\cdot P(FR_1)>TU(FR_2)\cdot P(FR_2),$$

in the case where the number of times threshold voltage cancel processing is performed is represented as P(FR), a length of a period during which one threshold voltage cancel processing is performed is represented as TU(FR), a first frame frequency is represented as $FR_1$ and a second frame frequency which is higher than the first frame frequency is $FR_1$ is represented as $FR_2$.

Here, it is preferable to apply a configuration in which a value of TU(FR) is fixed regardless of the frame frequency FR and a value of P(FR) is switched according to a value of the frame frequency FR. It is also preferable to apply a configuration in which the value of P(FR) is fixed regardless of the frame frequency FR and the value of TU(FR) is switched according to the value of the frame frequency FR. These configurations have an advantage that allows the control to be performed easier as any one of values of TU(FR) and P(FR) is switched according to the frame frequency FR. Additionally, it is preferable to apply a configuration in which both values of TR(FR) and P(FR) are switched according the value of the frame frequency FR. The configuration has an advantage that enables more accurate control corresponding to the frame frequency FR to be performed.

According to the embodiment of the invention including the preferred configurations, pre-processing which initializes a potential of a first node and a potential of a second node is performed, subsequently, the step (a) and the step (b) are performed, after that, in a state in which a write transistor is turned off by a scanning signal from a scanning line to make the first node to be in a floating state and a given drive voltage is applied to one source/drain region of a drive transistor from a feeding line, electric current corresponding to a value of potential difference between the first node and the second node is made to flow into a light emitting portion through a drive transistor, thereby driving the light emitting portion.

According to the embodiment of the invention in which the pre-processing is performed, it is preferable to apply a configuration in which the light emitting portion includes an anode electrode and a cathode electrode, and potentials of the first node and the second node are so set that the potential difference between a gate electrode and the other source/drain region of the drive transistor exceeds a threshold voltage of the drive transistor as well as that the potential difference between the anode electrode and the cathode electrode of the light emitting portion does not exceed a threshold voltage of the light emitting portion.

According to the embodiment of the invention including various preferred configurations explained above, a current-drive type light emitting portion which emits light by electric current flowing therein can be widely used as the light emitting portion included in the light emitting element. As the light emitting portion, an organic electroluminescence light emitting portion, an inorganic electroluminescence light emitting portion, an LED light emitting portion, a semiconductor laser light emitting portion and the like can be cited. These light emitting portions can be formed by using known materials and methods. The light emitting portion is preferably made of the organic electroluminescence light emitting portion among them from the perspective that a planar display device of color display is configured. The organic electroluminescence light emitting portion may be either a so-called top emission type or a bottom emission type.

Conditions shown in various formulas in the present specification are satisfied not only in the case where formulas are strictly effective mathematically but also in the case where formulas are substantially effective. In other words, various variations generated on design or manufacture of the display element and the display device are allowed concerning effective formulas.

When the potential of the second node reaches a potential obtained by subtracting a threshold voltage of the drive transistor from the potential of the first node by threshold voltage cancel processing, the drive transistor is turned off. On the other hand, when the potential of the second node does not reach the potential obtained by subtracting a threshold voltage of the drive transistor from the potential of the first node, the potential difference between the first node and the second node is larger than the threshold voltage of the drive transistor, and the drive transistor is not turned off. In the drive method according to the embodiment of the invention, potential change of the second node by the threshold voltage cancel processing is reduced as the frame frequency is increased. Therefore, it is basically not necessary that the drive transistor is turned off as a result of the threshold voltage cancel processing.

The writing processing may be performed immediately after the threshold voltage cancel processing is completed or may be performed after a given period of time. Additionally, the writing processing may be performed in a state in which a given drive voltage is applied to one source/drain region of the drive transistor or may be performed in a state in which the given drive voltage is not applied to one source/drain region of the drive transistor. In the former configuration, mobility correction processing is performed together which changes the potential of the other source/drain region of the drive transistor in accordance with characteristics of the drive transistor.

The display device may be configured as a monochrome display or maybe configured as a color display. For example, the display device may be configured as the color display, in which one pixel includes plural sub-pixels, specifically, one pixel includes three sub-pixels which are a red-light emitting sub-pixel, a green-light emitting sub-pixel and a blue-light emitting sub-pixel. Furthermore, the pixel maybe configured by a set to which one kind or plural kinds of sub-pixels are added to the above three kinds of sub-pixels (one set to which a sub-pixel emitting white light is added for improving luminance, one set to which a sub-pixel emitting a complementary color for expanding the range of reproducing colors, one set to which a sub-pixel emitting yellow for expanding the range of reproducing colors and one set to which sub-pixels emitting yellow and cyan for expanding the range of reproducing colors.

As pixel values of the display device, resolution for displaying pictures can be cited as follows, though it is not limited to these values: VGA (640, 480), S-VGA (800, 600), XGA (1024, 768), APRC (1152, 900), S-XGA (1280, 1024), U-XGA (1600, 1200), HD-TV (1920, 1080) and Q-XGA (2048, 1536) as well as (1920, 1035), (720, 480), (1280, 960) and the like.

In the display device, various wiring such as the scanning line, the data line and the feeding line as well as the light emitting portion can use known configurations and structures. For example, when the light emitting portion is made of the organic electroluminescence light emitting portion, the portion may includes an anode electrode, a hole transporting layer, a light emitting layer, an electron transporting layer, a cathode electrode and the like. Various circuits such as a power supply unit, a scanning circuit, a signal output circuit and a control circuit which are described later can be configured by using known circuit elements and so on.

As a transistor included in the drive circuit, an n-channel thin-film transistor (TFT) can be cited. The transistor included in the drive circuit may be either an enhancement type or a depletion type. In the n-channel transistor, an LDD (Lightly Doped Drain) structure may be formed. The LDD structure maybe formed asymmetrically in some cases. For example, large current flows through the drive transistor when the display element emits light, therefore, it is possible to apply a configuration in which the LDD structure is formed only on the side of one source/drain region to be the drain region side at the time of emitting light. Additionally, for example, a p-channel thin-film transistor can be used.

A capacitor unit included in the drive circuit may include one electrode, the other electrode and a dielectric layer (insulating layer) which is sandwiched by these electrodes. The transistor and the capacitor unit included in the drive circuit are formed in a given plane (for example, formed on a base), and the light emitting portion is formed, for example, on an upper portion of the transistor and the capacitor unit included in the drive circuit through an interlayer insulating layer. The other source/drain region is connected to the anode electrode included in the light emitting portion through, for example, a contact hole. It is also preferable to apply a configuration in which the transistor is formed on a semiconductor substrate and the like.

Hereinafter, the invention will be explained based on the embodiment with reference to the drawings, and an outline of a display device used in the embodiment will be explained before the explanation.

Explanation of an Outline of the Display Device Used in the Embodiment

A display device suitable for being used in the embodiment is a display device including plural pixels. One pixel includes plural sub-pixels (three sub-pixels which are a red-light emitting sub-pixel, a green-light emitting sub-pixel and a blue-light emitting sub-pixel in the embodiment). A current drive-type light emitting portion is configured by an organic electroluminescence light emitting portion. Each sub-pixel includes a display element 10 having a structure in which a drive circuit 11 and a light emitting portion (light emitting portion ELP) connected to the drive circuit 11 are stacked.

A conceptual diagram used in the embodiment is shown in FIG. 1.

Figure 2:
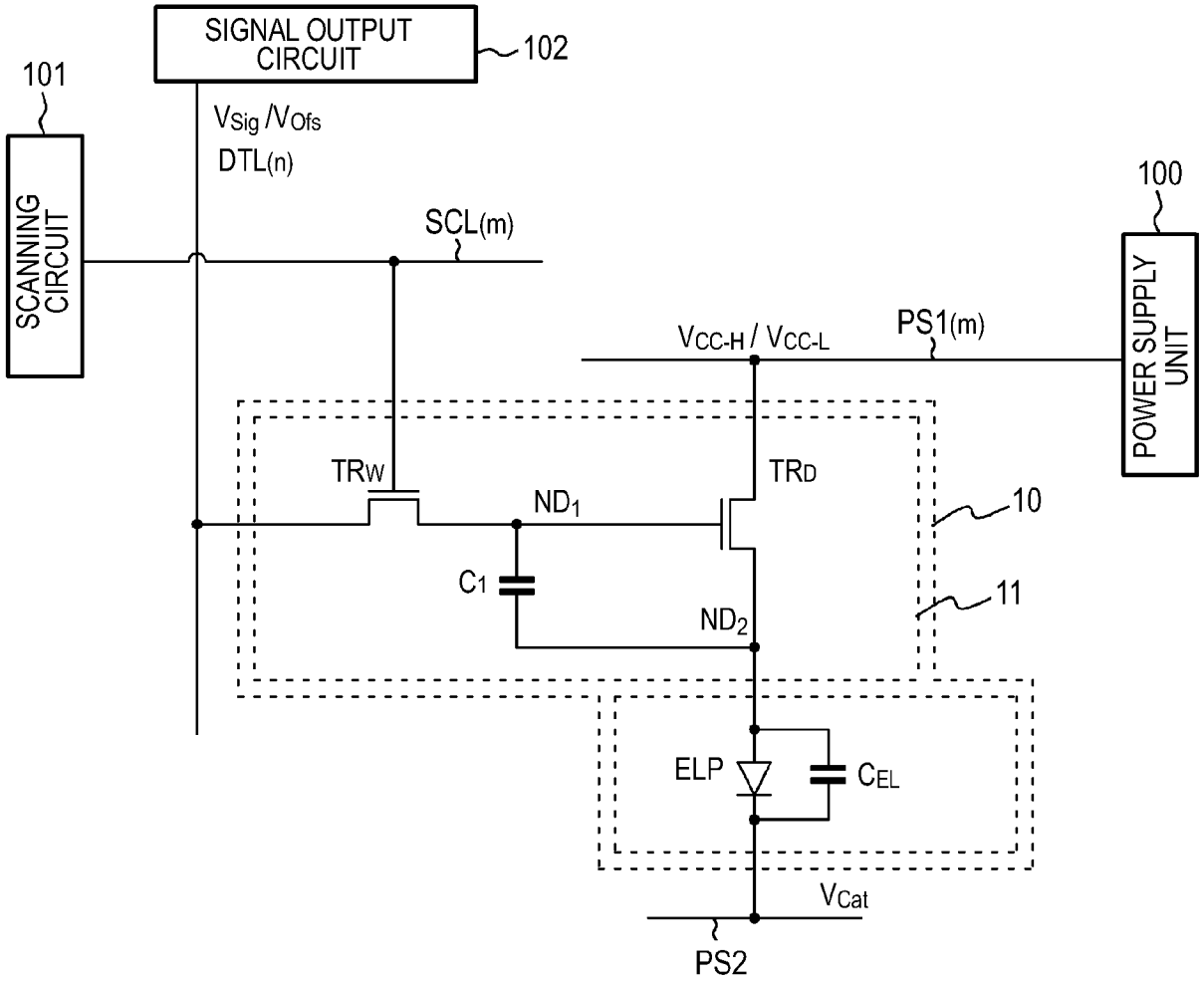
FIG. 2 is an equivalent circuit diagram of a display element including a drive circuit.

FIG. 2 shows a drive circuit (also referred to as a 2Tr/1C drive circuit) basically including two transistors and one capacitor unit.

As shown in FIG. 1, the display device used in the embodiment includes (1) the total N×M pieces of display elements 10 in which N-pieces in a first direction and M-pieces in a second direction different from the first direction are arranged in a two-dimensional matrix state, each having the current-drive type light emitting portion ELP and the drive circuit 11, (2) M-pieces of scanning lines SCL extending in the first direction, (3) N-pieces of data lines DTL extending in the second direction and (4) M-pieces of feeding lines PS1 extending in the first direction.

The feeding lines PS1 are connected to the power supply unit 100. The data lines DTL are connected to a signal output circuit 102. The scanning lines SCL are connected to a scanning circuit 101. Though 3×3 pieces of display elements are shown in FIG. 1, it is just exemplification.

The light emitting portion ELP has a known configuration or a structure including, for example, an anode electrode, a hole transporting layer, a light emitting layer, an electron transporting layer, a cathode electrode and the like. Configurations or structures of the scanning circuit 101, the signal line output circuit 102, the scanning line SCL, the data line DTL and the power supply unit 100 can be known configurations or structures. A configuration of a control circuit 103 will be described layer.

The minimum components of the drive circuit 11 are explained. The drive circuit 11 includes at least a drive transistor $TR_D$, a write transistor $TR_W$ and a capacitor unit $C_1$. The drive transistor $TR_D$ is configured by an n-channel TFT having source/drain regions, a channel forming region and a gate electrode. The write transistor $TR_W$ is also configured by an n-channel TFT having source/drain regions, a channel forming region and a gate electrode. The write transistor $TR_W$ maybe configured by a p-channel TFT. Additionally, the drive circuit 11 may have further another transistor.

In the drive transistor $TR_D$, (A-1) one source/drain region is connected to the feeding line PS1, (A-2) the other source/drain region is connected to one end of the light emitting portion ELP (an anode electrode included in the light emitting portion ELP in the embodiment) as well as connected to one of electrodes of the capacitor unit $C_1$, which configures a second node $ND_2$, and (A-3) a gate electrode of the drive transistor $TR_D$ is connected to the other source/drain region of the write transistor $TR_W$ as well as connected to the other of the capacitor unit C1, which configures a first node $ND_1$.

More specifically, in the display element 10 of the m-th row (m=1, 2 . . . M) and the n-th column (n=1, 2 . . . N) in the display device shown in FIG. 1, one source/drain region of the drive transistor $TR_D$ is connected to the m-th feeling line $PS1_m$.

In the write transistor $TR_W$, (B-1) one source/drain region is connected to the data line DTL, and (B-2) a gate electrode is connected to the scanning line SCL.

More specifically, in the display element 10 of the m-th row and the n-th column in the display device shown in FIG. 1, one source/drain region of the write transistor $TR_W$ is connected to the n-th data line $DTL_n$. A gate electrode of the write transistor $TR_W$ is connected to the m-th scanning line $SCL_m$.

The other end of the light emitting portion ELP (a cathode electrode included in the light emitting portion ELP in the embodiment) is connected to a second feeding line PS2.

More specifically, in the display element 10 of the m-th row and the n-th column in the display device shown in FIG. 1, the cathode electrode included in the light emitting portion ELP is connected to the common second feeding line PS2. The common second feeding line PS2 connected to the display element 10 of the m-th row and the n-th column may be also represented as a common second feeding line $PS2_m$ for convenience.

Figure 3:
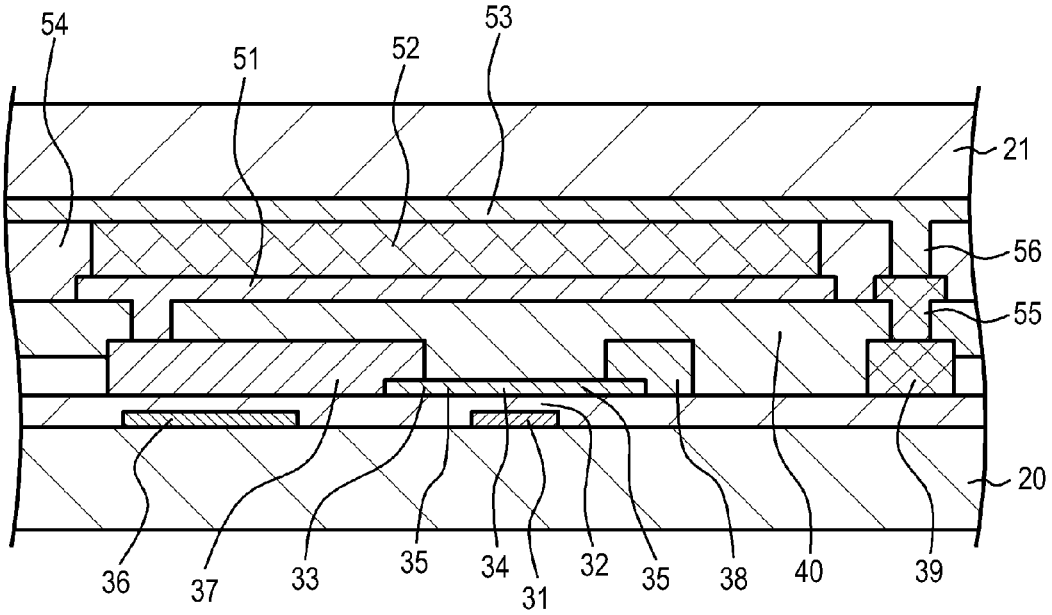
FIG. 3 is a schematic partial cross-sectional view of part of the display device.

FIG. 3 is a partial cross-sectional view schematically showing part of the display device. The transistors $TR_D$, $TR_W$ and the capacitor unit $C_1$ included in the drive circuit 11 are formed on a base 20, and the light emitting portion ELP is formed, for example, above the transistors $TR_D$, $TR_W$ and the capacitor unit $C_1$ included in the drive circuit 11 through an interlayer insulating layer 40. The other source/drain region of the drive transistors $TR_D$ is connected to the anode electrode included in the light emitting portion ELP through a contact hole. In FIG. 3, only the drive transistors $TR_D$ is shown. The other transistor is hidden.

More specifically, the drive transistor $TR_D$ includes a gate electrode 31, a gate insulating layer 32, source/drain regions 35, 35 provided at a semiconductor layer 33, and a channel forming region 34 corresponding to a portion of the semiconductor layer 33 between the source/drain regions 35, 35. The capacitance unit $C_1$ is configured by the other electrode 36, a dielectric layer formed by an extended portion of the gate insulating layer 32 and one electrode 37 (corresponding to the second node $ND_2$). The gate electrode 31, part of the gate insulating layer 32 and the other electrode 36 included in the capacitor unit $C_1$ are formed on the base 20. One source/drain region 35 of the drive transistor $TR_D$ is connected to a wiring 38 and the other source/drain region 35 is connected to one electrode 37. The drive transistor $TR_D$, the capacitor unit $C_1$ and the like are covered with the interlayer insulating layer 40, and the light emitting portion ELP including an anode electrode 51, a hole transporting layer, a light emitting layer, an electron transporting layer and a cathode electrode 53 is provided on the interlayer insulating layer 40. In the drawing, the hole transporting layer, the light emitting layer and the electron transporting layer are represented by one layer 52. Over a portion of the interlayer insulating layer 40 where the light emitting portion ELP is not provided, a second interlayer insulating layer 54 is provided and a transparent substrate 21 is arranged over the second interlayer insulating layer 54 and the cathode electrode 53. Light emitted at the light emitting layer is transmitted through the substrate 21 and radiated to the outside. One electrode 37 (second node $ND_2$) and the anode electrode 51 are connected by a contact hole provided in the interlayer insulating layer 40. The cathode electrode 53 is connected to a wiring 39 provided on the extended portion of the gate insulating layer 32 through contact holes 56, 55 provided in the second interlayer insulating layer 54 and the interlayer insulating layer 40.

A method of manufacturing the display device shown in FIG. 3 and the like will be explained. First, various types of wirings such as the scanning line SCL, the electrodes included in the capacitor unit C1, the transistors made of a semiconductor layer, the interlayer insulating layer, the contact holes and the like are suitably formed by a known method. Subsequently, deposition and patterning are performed by known methods and the light emitting portions ELP arranged in a matrix state are formed. After the base 20 and the substrate 21 which have received the above processes are allowed to face each other and the periphery is sealed, wire connection with respect to outside circuits is performed to obtain the display device.

The display device in each embodiment is a color display device including plural display elements 10 (for example, N×M=1920×480). Each display element 10 includes sub-pixels as well as configures one pixel by a group having plural sub-pixels, and pixels are arranged in the two-dimensional matrix state in the first direction and the second direction which is different from the first direction. One pixel includes three kinds of sub-pixels which are the red-light emitting sub-pixel emitting red, the green-light emitting sub-pixel emitting green and the blue-light emitting sub-pixel emitting blue, which are arranged in a direction to which the scanning line SCL extends.

The display device includes (N/3)×M pieces of pixels arranged in the two-dimensional matrix state. The display elements 10 which configure respective pixels are line-sequentially scanned, and a frame frequency (frame rate) is represented as FR(Hz). The display elements 10 configuring respective (N/3) pieces of pixels (N-pieces of sub-pixels) arranged in the m-th row are simultaneously driven. In other words, in respective display elements 10 included in one row, light-emitting/non-light emitting timing is controlled by each row to which these display elements belong. The processing of writing a video signal to respective pixels included in one row may be the processing of writing the video signal to all pixels at the same time (also referred to merely as simultaneous writing processing), or the processing of writing the video signal to respective pixels sequentially (also referred to merely as sequential writing processing). Which writing processing is applied may be appropriately selected according to the configuration of the display device.

As described above, the display elements 10 of the first row to the m-th row are line-sequentially scanned. For convenience of explanation, a period allocated for scanning the display elements 10 of each row is referred to as a horizontal scanning period. In each later-described embodiment, there exist a period in which a first node initialization voltage (later-described $V_{0fs}$) is applied to the data line DTL (referred to as an initialization period in the following description), subsequently, a period in which the video signal (later-described $V_{Sig}$) is applied to the data line DTL from the signal output circuit 102 in each horizontal scanning period (referred to as a video signal period).

In principle, drive and operation concerning the display element 10 positioned at the m-th row and the n-th column will be explained, in which the display element 10 is referred to as an (n, m)th display element 10 or an (n, m)th sub-pixel. Then, various processing (threshold voltage cancel processing, writing processing and mobility correction processing) is performed before the horizontal scanning period of respective display elements 10 arranged in the m-the row (the m-th horizontal scanning period) is finished. The writing processing and mobility correction processing are performed during the m-th horizontal scanning period. On the other hand, the threshold voltage cancel processing and accompanying preprocessing are performed before the m-th horizontal scanning period.

After all the above various processing is completed, the light emitting portions ELP included in respective display elements 10 arranged in the m-th row are allowed to emit light. It is preferable that the light emitting portions ELP are allowed to emit light immediately after all the above various processing is completed, or it is also preferable that the light emitting portions ELP are allowed to emit light after a given period (for example, horizontal scanning periods for the given number of rows) is passed. The given period can be appropriately set in accordance with specifications of the display device, the configuration of the drive circuit and so on. In the following explanation, the light emitting portions ELP are allowed to emit light immediately after various processing is performed for convenience of explanation. The light emitting state of the light emitting portions ELP included in respective display elements 10 arranged in the m-th row is continued just before the start of the horizontal scanning period of respective display elements 10 arranged in the (m+m') th row. Here, "m'" is determined according to design specifications of the display device. That is, light emission of the light emitting portions ELP included in respective display elements 10 arranged in the m-th row is continued until the (m+m'−1) th horizontal scanning period in a given display frame. On the other hand, the light emitting portions ELP included in respective display elements 10 arranged in the m-th row maintain the non-light emitting state from the beginning of the (m+m')th horizontal scanning period until the writing processing and the mobility correction processing are completed in the m-th horizontal scanning period in a next display frame in principle. The above period of the non-light emitting state (also referred to merely as a non-light emitting period) is provided, thereby reducing residual image blur due to active matrix drive and allowing the quality of moving pictures to be more excellent. However, the light emitting state and the non-light emitting state of respective sub-pixels (display elements 10) are not limited to the states described above. The time length of the horizontal scanning period is the time length less than (1/FR)×(1/M). When a value of (m+m') exceeds "M", the exceeded horizontal scanning period will be processed in the next display frame. In the following description, the frame frequency FR takes various values, however, the time length of the horizontal scanning period is assumed to be fixed to a given value regardless of the frame frequency.

In two source/drain regions included in one transistor, a word "one source/drain region" may be used in a sense of the source/drain region connected to the power supply side. "The transistor is in on-state" indicates a state in which a channel is formed between the source/drain regions. It is no matter whether electric current flows from one source/drain region to the other source/drain region or not. On the other hand, "the transistor is in off-state" indicates a state in which a channel is not formed between the source/drain regions. Additionally, "the source/drain region of a given transistor is connected to the source/drain region of another transistor" includes a form in which the source/drain region of the given transistor and the source/drain region of another transistor occupy the same region. Furthermore, the source/drain regions can be configured by not only conductive materials such as polysilicon or amorphous silicon including impurities but also metal, alloys, conductive particles, a stacked structure of these materials or a layer including organic materials (conductive polymer). In a timing chart used for the following explanation, lengths in a horizontal axis indicating respective periods (time lengths) are schematically shown, which do not indicate the ratio of time lengths in respective periods. It is the same also with respect to a vertical axis. The shape of waveforms in the timing chart is also schematically shown.

Hereinafter, the invention will be explained based on the embodiment.

[Embodiment]

The embodiment relates to a drive method of the display device to which the invention is applied.

As shown in FIG. 2, the drive circuit 11 included in the display element 10 includes two transistors, namely, the write transistor $TR_W$ and the drive transistor $TR_D$, and one capacitor unit $C_1$ (2Tr/1C drive circuit). A configuration of the (n, m) th display element 10 will be explained.

[Drive Transistor $TR_D$]

One source/drain region of the drive transistor $TR_D$ is connected the m-th feeding line $PS1_m$. To one source/drain region of the drive transistor $TR_D$, a given voltage is applied from the m-th feeding line $PS1_m$ based on the operation of the power supply unit 100. Specifically, a drive voltage $V_{CC-H}$ and a voltage $V_{CC-L}$ which are later described is supplied from the power supply unit 100. On the other hand, the other source/drain region of the drive transistor $TR_D$ is connected to (1) the anode electrode of the light emitting portion ELP and (2) one electrode of the capacitor unit C1, which configures the second $ND_2$. The gate electrode of the drive transistor $TR_D$ is connected to (1) the other source/drain region of the write transistor $TR_W$ and (2) the other electrode of the capacitor unit C1, which configures the first node $ND_1$.

Here, voltage in the drive transistor $TR_D$ is set to be operated in a saturation region when the display element 10 is in the light emitting state, which is driven to allow the drain current $I_{ds}$ to flow in accordance with the following formula (1). In the light emitting state of the display element 10, one source/drain region of the drive transistor $TR_D$ functions as a drain region and the other source/drain region functions as a source region. For convenient of explanation, one source/drain region of the drive transistor $TR_D$ may be referred to merely as the drain region and the other source/drain region is referred to merely as the source region. In the formula (1), μ: effective mobility L: channel length W: channel width $V_{gs}$: potential difference between the gate electrode and the source region $V_{th}$: threshold voltage $C_{ox}$: (relative permittivity of a gate insulating layer)×(permittivity of vacuum)/(thickness of the gate insulating layer)

$$k \equiv (1/2)\cdot(W/L)\cdot C_{ox}$$

$$I_{ds} = k\cdot\mu\cdot(V_{gs} - V_{th})^2 \quad (1)$$

The drain current $I_{ds}$ flows through the light emitting portion ELP of the display element 10 to thereby allow the light emitting portion ELP to emit light. Furthermore, the light emitting state (luminance) in the light emitting portion ELP of the display device 10 is controlled according to the size of a value of the drain current $I_{ds}$.

[Write Transistor $TR_W$]

The other source/drain region of the write transistor $TR_W$ is connected to the gate electrode of the drive transistor $TR_D$ as described above. On the other hand, one source/drain region of the write transistor $TR_W$ is connected to the n-th data line $DTL_n$. To one source/drain region of the write transistor $TR_W$, a given voltage is applied from the n-th data line $DTL_n$ based on operation of the signal output circuit 102. Specifically, a video signal (drive signal, luminance signal) $V_{Sig}$ for controlling luminance in the light emitting portion ELP and a later-described first node initialization voltage $V_{0fs}$ are supplied from the signal output circuit 102. ON/OFF operation of the write transistor $TR_W$ is controlled by a scanning signal from the m-th scanning line $SCL_m$ connected to the gate electrode of the write transistor $TR_W$, specifically, the scanning signal from the scanning circuit 101.

[Light Emitting Portion ELP]

The anode electrode of the light emitting portion ELP is connected to the source region of the drive transistor $TR_D$ as described above. On the other hand, the cathode electrode of the light emitting portion ELP is connected to the m-th second feeling line $PS2_m$. To the cathode electrode of the light emitting portion ELP, a later-described given voltage $V_{Cat}$ is applied from the m-th second feeling line $PS2_m$. A capacitor of the light emitting portion ELP is represented by a code $C_{EL}$. A threshold voltage necessary for light emission of the light emitting portion ELP is represented by $V_{th\text{-}EL}$. That is, when voltage equal to or more than $V_{th\text{-}EL}$ is applied between the anode electrode and the cathode electrode of the light emitting portion ELP, the light emitting portion ELP emits light.

Next, the display device and the drive method thereof according to the embodiment will be explained.

In the following description, values of voltage or potential will be represented as follows. These are just values for explanation and they are not limited to these values.

$V_{Sig}$: a video signal for controlling luminance in the light emitting portion ELP . . . 1V (black display) to 8V (white display)

$V_{CC\text{-}H}$: drive voltage for allowing current to flow through the light emitting portion ELP . . . 20V $V_{CC\text{-}L}$: second initialization voltage . . . −10V $V_{0fs}$: first node initialization voltage for initializing a potential of the gate electrode of the drive transistor $TR_D$ (potential of the first node $ND_1$) . . . 0V $V_{th}$: threshold voltage of the drive transistor $TR_D$ . . . 3V $V_{Cat}$: voltage applied to the cathode electrode of the light emitting portion ELP . . . 0V $V_{th\text{-}EL}$: threshold voltage of the light emitting portion ELP . . . 3V The drive method of the display device according to the embodiment includes the steps of (a) performing threshold voltage cancel processing at least once, which changes a potential of the second node $ND_2$ toward a potential obtained by subtracting the threshold voltage $V_{th}$ of the drive transistor $TR_D$ from a potential of the first node $ND_D$ by applying a given drive voltage $V_{CC\text{-}H}$ to one source/drain region of the drive transistor $TR_D$ from the feeding line $PS1_m$ while maintaining the potential of the first node $ND_D$, then, (b) performing writing processing which applies the video signal $V_{Sig}$ to the first node $ND_D$ from the data line $DTL_n$ through the write transistor $TR_W$.

In the embodiment, pre-processing for initializing the potential of the first node $ND_1$ and the potential of the second node $ND_2$ is performed. Next, the above step (a) and step (b) are performed. After that, the write transistor $TR_W$ is turned off based on a scanning signal from the scanning line SCL to thereby allow the first node $ND_1$ to be in a floating state. Electric current corresponding to a value of the potential difference between the first node $ND_1$ and the second node $ND_2$ is allowed to flow into the light emitting portion ELP through the drive transistor $TR_D$ in a state in which the given drive voltage $V_{CC\text{-}H}$ is applied to one source/drain region of the drive transistor $TR_D$ from the feeling line PS1, which drives the light emitting portion ELP.

As described above, the light emitting portion ELP includes the anode electrode and the cathode electrode. The pre-processing is a step for setting the potential of the first node $ND_1$ and the potential of the second node $ND_2$ so that the voltage difference between the gate electrode and the other source/drain region of the drive transistor $TR_D$ exceeds the threshold voltage $V_{th}$ of the drive transistor $TR_D$ as well as the potential difference between the anode potential and the cathode potential of the light emitting portion ELP does not exceed the threshold voltage $V_{th\text{-}EL}$ of the light emitting portion ELP.

In the embodiment, the threshold cancel processing is performed plural times over plural scanning periods. First, a basic principle in the drive method of the display device according to the embodiment will be explained for helping understanding of the invention. A timing chart of driving of the display element 10 is schematically shown in FIG. 4, and an ON/OFF state and the like of respective transistors of the display element 10 are schematically shown in FIGS. 5A to 5F and FIGS. 6A to 6F.

For convenience of explanation, in operations shown in FIG. 4, explanation will be made assuming that the threshold voltage cancel processing is performed over the (m−2)th horizontal scanning period $H_{m-2}$ to the m-th horizontal scanning period $H_m$. Actually, the threshold voltage cancel processing is performed over further longer horizontal periods.

Figure 4:
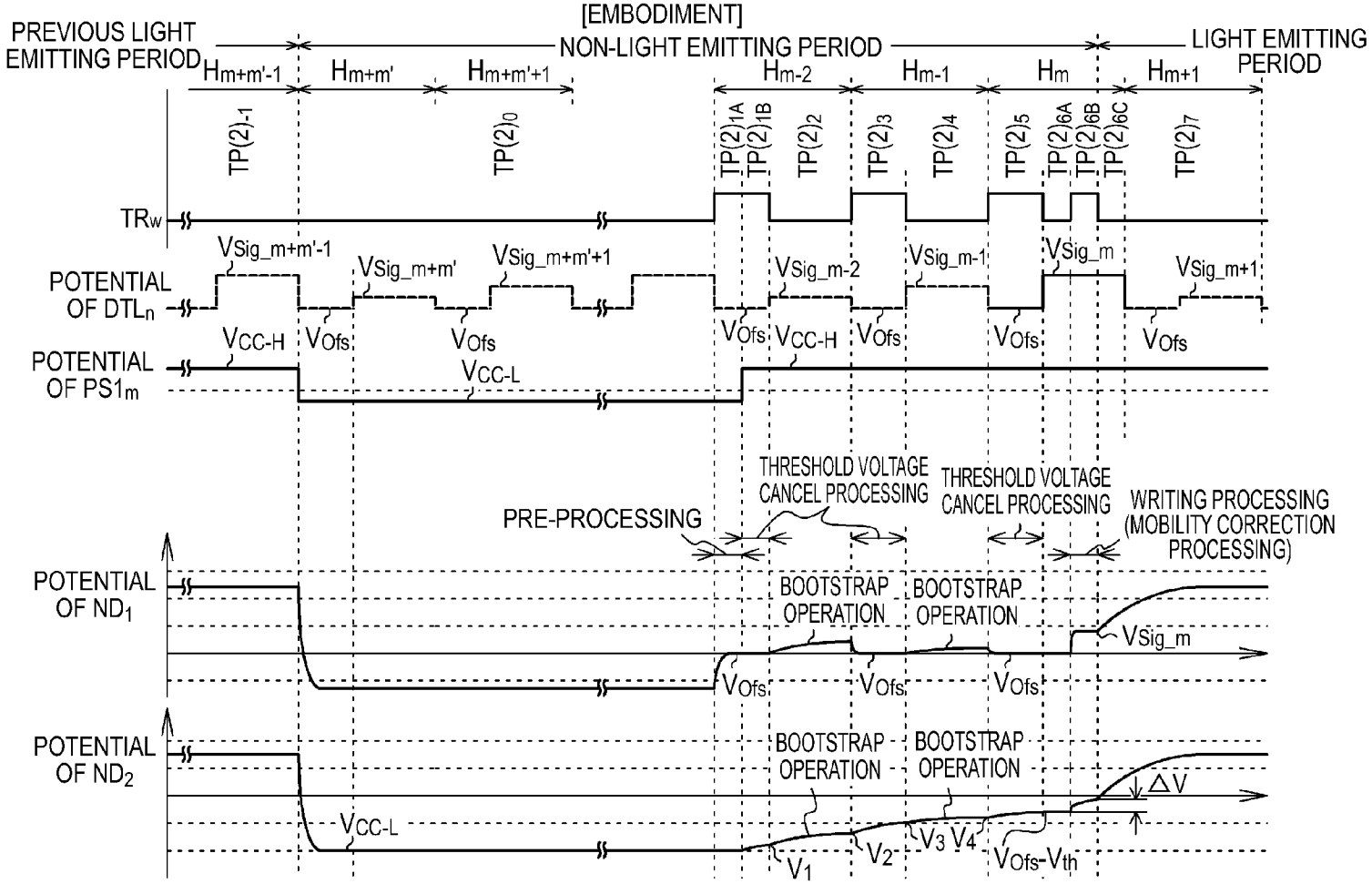
FIG. 4 is a schematic view of a timing chart of driving of the display element according to the embodiment.

[Period-TP(2)$_{-1}$] (Refer to FIG. 4 and FIG. 5A)

[Period-TP(2)$_{-1}$] is, for example, an operation in a previous display frame, which is a period in which the (n, m)th display element 10 is in the light emitting state after various previous processing has been completed. That is, a drain current $I'_{ds}$ based on a later-described formula (5') flows through the light emitting portion ELP in the display element 10 forming the (n, m)th sub-pixel and luminance of the display element 10 forming the (n, m)th sub-pixel is a value corresponding to the drain current $I'_{ds}$. Here, the write transistor $TR_W$ is in the off state and the drive transistor $TR_D$ is in the on-state. The (n, m)th light emitting state of the is continued to just before the horizontal scanning period of the display element 10 arranged in the (m+m')th row.

The first initialization voltage $V_{0fs}$ and the video signal $V_{Sig}$ is applied to the data line $DTL_n$ so as to correspond to each horizontal scanning period. However, the write transistor $TR_W$ is in the off-state, therefore, the potentials of the first node $ND_1$ and the second node $ND_2$ do not change even when the potential (voltage) of the data line $DTL_n$ changes in [Period-TP(2)$_{-1}$] (actually, potential change due to capacitive coupling such as parasitic capacitance and so on may occur, but these can be ignored). It is the same with respect to later-described [Period-TP(2)$_0$]

A period from [Period-TP(2)$_0$] to [Period-TP(2)$_{6A}$] shown in FIG. 4 is an operation period from the light emitting state after the various previous processing has been completed to just before the next writing processing is performed. In a period from [Period-TP(2)$_0$] to [Period-TP(2)$_{6B}$], the (n, m)th display element 10 is in the non-light emitting state in principle. As shown in FIG. 4, in addition to [Period-TP(2)$_5$] and [Period-TP(2)$_{6A}$], [Period-TP(2)$_{6B}$] and [Period-TP(2)$_{6C}$] are included in the m-th horizontal scanning period $H_m$.

For convenience of explanation, the beginning of [Period-TP(2)$_{1A}$] is assumed to correspond to the beginning of an initialization period in the (m−2)th horizontal scanning period $H_{m-2}$ (a period in which the potential of the data line $DTL_n$ is $V_{0fs}$ in FIG. 4, which is the same with respect to other horizontal scanning periods). Similarly, the end of [Period-TP(2)$_{1B}$] is assumed to correspond to the end of the initialization period in the horizontal scanning period $H_{m-2}$. Also, the beginning of [Period-TP(2)$_2$] is assumed to correspond to the beginning of a video signal period in the horizontal scanning period $H_{m-2}$ (the period in which the potential of the data line $DTL_n$ is the video signal $V_{Sig}$ in FIG. 4, which is the same with respect to other horizontal scanning periods).

Hereinafter, respective periods of [Period-TP(2)$_0$] to [Period-TP(2)$_7$] will be explained. The beginning of the [Period-TP(2)$_{1B}$] and lengths of respective periods of [Period-TP(2)$_{6A}$] to [Period-TP(2)$_{6C}$] may be appropriately set according to design of the display element and the display device.

[Period-TP(2)$_0$] (Refer to FIG. 4 and FIG. 5B)

[Period-TP(2)$_0$] is, for example, an operation from the previous display frame to the current display frame. That is, [Period-TP(2)$_0$] is a period from the beginning of the (m+m') th horizontal scanning period $H_{m+m'}$ in the previous display frame to the (m−3)th horizontal scanning period in the current display frame. In [Period-TP(2)$_0$], the (n, m)th display device 10 is in the non-light emitting state in principle. At the beginning of [Period-TP(2)$_0$], the voltage supplied to the feeding line $PS1_m$ from the power supply unit 100 is switched from the drive voltage drive voltage $V_{CC-H}$ to the second node initialization voltage $V_{CC-L}$. As a result, the potential of the second node $ND_2$ is reduced to $V_{CC-L}$, reverse-direction voltage is applied between the anode electrode and the cathode electrode of the light emitting portion ELP, and the light emitting portion ELP becomes in the non-light emitting state. The potential of the first node $ND_1$ in the floating state (gate electrode of the drive transistor $TR_D$) is also reduced in accordance with the potential reduction of the second node $ND_2$

[Period-TP(2)$_{1A}$] (Refer to FIG. 4 and FIG. 5C)

Then, the (m−2) th horizontal scanning period $H_{m-2}$ in the current display frame is started. In [Period-TP(2)$_{1A}$] pre-processing is performed.

As described above, in respective horizontal scanning periods, the first node initialization voltage $V_{0fs}$ is applied to the data line $DTL_n$ from the signal output circuit 102, subsequently, the video signal $V_{Sig}$ is applied instead of the first node initialization voltage $V_{0fs}$. More specifically, the first node initialization voltage $V_{0fs}$ is applied to the data line $DTL_n$, subsequently, a video signal corresponding to the (n, m−2)th sub-pixel (represented as $V_{Sig_m-2}$ for convenient. It is the same with respect to other video signals) is applied instead of the first node initialization voltage $V_{0fs}$, corresponding to the (m−2) th horizontal scanning period $H_{m-2}$ in the current display frame. It is the same with respect to other horizontal scanning periods. Though not shown in FIG. 4, the first initialization voltage $V_{0fs}$ and the video signal $V_{Sig}$ are applied to the data line $DTL_n$ in respective horizontal scanning periods other than the horizontal scanning periods $H_{m-2}$, $H_{m-1}$, $H_m$, $H_{m+1'}$, and $H_{m+m'}$.

Specifically, the scanning line $SCL_m$ is made high in level at the beginning of [Period-TP(2)$_{1A}$], thereby turning on the write transistor $TR_W$. The voltage applied to the data line $DTL_n$ from the signal output circuit 102 is $V_{0fs}$ (initialization period). As a result, the potential of the first node $ND_1$ will be $V_{ofs}$ (0V). Since the second node initialization voltage $V_{CC-L}$ is applied to the second node $ND_2$ from the feeding line $PS1_m$ based on operation of the power supply unit 100, the potential of the second node $ND_2$ is maintained to $V_{CC-L}$ (−10V).

The voltage difference between the first node $ND_1$ and the second node $ND_2$ is 10V, and the threshold voltage $V_{th}$ of the drive transistor $TR_D$ is 3V, therefore, the drive transistor $TR_D$ is in on-state. The voltage difference between the second node $ND_2$ and the cathode electrode included in the light emitting portion ELP is −10V, which does not exceed the threshold voltage $V_{th-EL}$ of the light emitting portion ELP. Accordingly, the pre-processing which initializes the potential of the first node $ND_1$ and the potential of the second node $ND_2$ is completed.

When the pre-processing is performed, it is preferable to apply a configuration in which the write transistor $TR_W$ is turned on after waiting for the voltage applied to the data line $DTL_n$ to be switched to the first node initialization voltage $V_{0fs}$. Additionally, it is also possible to apply a configuration in which the write transistor $TR_W$ is turned on by the signal from the scanning line before the beginning of the horizontal scanning period in which the pre-processing is performed. According to the latter configuration, the potential of the first node $ND_1$ is initialized immediately after the first node initialization voltage $V_{0fs}$ is applied to the data line $DTL_n$. According to the former configuration in which the write transistor $TR_W$ is turned on after waiting for the voltage applied to the data line $DTL_n$ to be switched to the first node initialization voltage $V_{0fs}$, it is necessary to allocate time to the pre-processing including time of waiting for the switching. On the other hand, according to the latter configuration, the time of waiting for the switching is not necessary and the pre-processing can be performed in a short time.

Next, the above-described step (a), namely, the threshold voltage cancel processing is performed over a period from [Period-TP(2)$_{1B}$] to [Period-TP(2)$_5$]. Specifically, the first threshold voltage cancel processing is performed in [Period-TP(2)$_{1B}$], the second threshold voltage cancel processing is performed in [Period-TP(2)$_3$], and the third threshold voltage cancel processing is performed in [Period-TP(2)$_5$].

[Period-TR(2)$_{1B}$] (Refer to FIG. 4, FIG. 5D]

That is, the voltage supplied to the feeding line PS1$_m$ from the power supply unit 100 is switched from the voltage $V_{CC-L}$ to the drive voltage $V_{CC-H}$ while maintaining on-state of the write transistor $TR_W$. As a result, the potential of the first node $ND_1$ does not change (maintaining $V_{0fs}$=0V), however, the potential of the second node $ND_2$ is changed toward a potential obtained by subtracting the threshold voltage $V_{th}$ of the drive transistor $TR_D$ from the potential of the first node $ND_1$. That is, the potential of the second node $ND_z$ is increased.

When [Period-TP(2)$_{1B}$] is sufficiently long, the potential difference between the gate electrode and the other source/drain region of the drive transistor $TR_D$ reaches $V_{th}$, and the drive transistor $TR_D$ is turned off. That is, the potential of the second node $ND_2$ becomes close to ($V_{0fs}-V_{th}$) and finally reaches ($V_{0fs}-V_{th}$). However, in the example shown in FIG. 4, the length of [Period-TP(2)$_{1B}$] is not sufficiently long for sufficiently changing the potential of the second node $ND_2$, and the potential of the second node $ND_2$ reaches a given potential $V_1$ which satisfies the relation of $V_{CC-H}<V_1<(V_{0fs}-V_{th})$ at the end of [Period-TP(2)$_{1B}$].

[Period-TP(2)$_2$] (Refer to FIG. 4, FIG. 5E)

At the beginning of [Period-TP(2)$_2$], the potential of the data line $DTL_n$ is switched from the first node initialization voltage $V_{0fs}$ to the video signal $V_{Sig_m-2}$. The write transistor $TR_W$ is turned off by the signal from the scanning line $SCL_m$ at the beginning of [Period-TP(2)$_2$] so that the video signal $V_{Sig_m-2}$ is not applied to the first node $ND_1$. As a result, the first node $ND_1$ is in the floating state.

Since the drive voltage $V_{CC-H}$ is applied to one source/drain region of the drive transistor $TR_D$ from the power supply unit 100, therefore, the potential of the second node $ND_2$ is increased from the potential $V_1$ to a given potential $V_2$. On the other hand, since the gate electrode of the drive transistor $TR_D$ is in the floating state and there exists the capacitor unit $C_1$, a bootstrap operation is generated at the gate electrode of the drive transistor $TR_D$. Accordingly, the potential of the first node $ND_1$ is increased in accordance with the potential change of the second node $ND_2$.

[Period-TP(2)$_3$] (Refer to FIG. 4, FIG. 5F)

At the beginning of [Period-TP(2)$_3$], the potential of the data line $DTL_n$ is switched from the video signal $V_{Sig_m-2}$ to the first node initialization voltage $V_{0fs}$. At the beginning of [Period-TP(2)$_3$], the write transistor $TR_W$ is turned on by the signal from the scanning line $SCL_m$. As a result, the potential of the first node $ND_1$ will be $V_{0fs}$. The drive voltage $V_{CC-H}$ is applied to one source/drain region of the drive transistor $TR_D$ from the power supply unit 100. As a result, the second $ND_2$ is changed toward a potential obtained by subtracting the threshold voltage $V_{th}$ of the drive transistor $TR_D$ from the potential of the first node $ND_1$. That is, the potential of the second $ND_2$ is increased from the potential $V_2$ to a given potential $V_3$.

[Period-TP(2)$_4$] (Refer to FIG. 4, FIG. 6A)

At the beginning of [Period-TP(2)$_4$], the potential of the data line $DTL_n$ is switched from the first node initialization voltage $V_{0fs}$ to the video signal $V_{Sig-m-1}$. The write transistor $TR_W$ is turned off by the signal from the scanning line $SCL_m$ at the beginning of [Period-TP(2)$_4$] so that the video signal $V_{Sig_m-1}$ is not applied to the first node $ND_1$. As a result, the first node $ND_1$ is in the floating state.

Since the drive voltage $V_{CC-H}$ is applied to one source/drain region of the drive transistor $TR_D$ from the power supply unit 100, therefore, the potential of the second node $ND_2$ is increased from the potential $V_3$ to a given potential $V_4$. On the other hand, since the gate electrode of the drive transistor $TR_D$ is in the floating state and there exists the capacitor unit $C_1$, the bootstrap operation is generated at the gate electrode of the drive transistor $TR_D$. Accordingly, the potential of the first node $ND_1$ is increased in accordance with the potential change of the second node $ND_2$.

As a prerequisite of an operation in [Period-TP(2)$_5$], it is necessary that the potential $V_4$ of the second node $ND_2$ is lower than ($V_{0fs-Vth}$) at the beginning of [Period-TP(2)$_5$]. The length from the beginning of [Period-TP(2)$_{1B}$] to the beginning of [Period-TP(2)$_5$] is determined to satisfy a condition of $V4<(V_{0fs-L}-V_{th})$.

[Period-TP(2)$_5$] (Refer to FIG. 4, FIG. 6B)

An operation of [Period-TP(2)$_5$] is basically the same as the operation explained in [Period-TP(2)$_3$]. At the beginning of [Period-TP(2)$_5$], the potential of the data line $DTL_n$ is switched from the video signal $V_{Sig_m-1}$ to the first node initialization voltage $V_{0fs}$. The write transistor $TR_W$ is turned on by the signal from the scanning line $SCL_m$ at the beginning of [Period-TP(2)$_5$].

The first node $ND_1$ is in a state in which the first node initialization voltage $V_{0fs}$ is applied from the data line $DTL_n$ through the write transistor $TR_W$. Since drive voltage $V_{CC-H}$ is applied to one source/drain region of the drive transistor $TR_D$ from the power supply unit 100, the potential of the second node $ND_2$ is changed toward a potential obtained by subtracting the threshold voltage $V_{th}$ of the drive transistor $TR_D$ from the potential of the first node $ND_1$ in the same manner as explained in [Period-TP(2)$_3$]. Then, when the potential difference between the gate electrode and the other source/drain region of the drive transistor $TR_D$ reaches $V_{th}$, the drive transistor $TR_D$ is turned off. In this state, the potential of the second node $ND_2$ is almost ($V_{0fs}-V_{th}$). Here, when the following (2) is certified, in other words, when the potential is selected and determined to satisfy the formula (2), the light emitting portion ELP does not emit light.

$$(V_{0fs}-V_{th})<(V_{th-EL}+V_{Cat}) \quad (2)$$

In [Period-TP(2)$_5$], the potential of the second node $ND_2$ will be ($V_{0fs}-V_{th}$) finally. That is, the potential of the second node $ND_2$ is determined only depending on the threshold voltage $V_{th}$ of the drive transistor $TR_D$ and the voltage $V_{0fs}$ for initializing the potential of the gate electrode of the drive transistor $TR_D$. Then, the potential of the second node $ND_2$ has no relation to the threshold voltage $V_{th-EL}$ of the light emitting portion ELP.

[Period-TP(2)$_{6A}$] (Refer to FIG. 4, FIG. 6C)

At the beginning of [Period-TP(2)$_{6A}$], the write transistor $TR_W$ is turned off by the scanning signal from the scanning line $SCL_m$. The voltage to be applied to the data line $DTL_n$ is switched from the first node initialization voltage $V_{0fs}$ to the video signal $V_{Sig_m}$ (video signal period). When the drive transistor $TD_R$ reaches the off-state in the threshold voltage cancel processing, potentials of the first node $ND_1$ and the $ND_2$ do not change. When the drive transistor $TD_R$ does not reach the off-state in the threshold voltage cancel processing performed in [Period-TP($\mathbf{2}$)$_5$], the bootstrap operation is generated in [Period-TP($\mathbf{2}$)$_{6A}$] and potentials of the first node $ND_1$ and the $ND_2$ are increased to some degree.

[Period-TP($\mathbf{2}$)$_{6A}$] (Refer to FIG. 4, FIG. 6D)

In this period, the above step (b), namely, writing processing is performed. The write transistor $TR_W$ is turned on by the scanning signal from the scanning line $SCL_m$. Then, the video signal $V_{Sig_m}$ is applied to the first node $ND_1$ from the data line $DTL_n$ through the write transistor $TR_W$. As a result, the potential of the first node $ND_1$ is increased to $V_{Sig_m}$. The drive transistor $TD_R$ is in on-state. It is also possible to apply a configuration in which the write transistor $TR_W$ maintains on-state in [Period-TP($\mathbf{2}$)$_{6A}$] in some cases. In the configuration, writing processing is stated immediately after the voltage of the data line $DTL_n$ is switched from the first node initialization voltage $V_{0fs}$ to the video signal $V_{Sig_m}$. This is also the same in a later-described embodiment.

Here, a value of the capacitor unit $C_1$ is represented as "$c_1$" and a value of the capacitor $C_{EL}$ of the light emitting portion ELP is represented as $c_{EL}$. Then, a value of a capacitor between the gate electrode and the other source/drain region of the drive transistor $TR_D$ is represented as $c_{gs}$. When a capacitance value between the first node $ND_1$ and the second node $ND_2$ is represented as a code $c_A$, $c_A=c_1+c_{gs}$. When a capacitance value between the second node $ND_2$ and the second feeding line PS2 is represented as a code $c_B$, $c_B=c_{EL}$. A configuration in which additional capacitor units are connected in parallel to both ends of the light emitting portion ELP can be applied, and capacitance values of the additional capacitor units are further added to $c_B$.

When the potential of the gate electrode of the drive transistor $TR_D$ is changed from $V_{0fs}$ to $V_{Sig_m}$ ($>_{0fs}$) the potential between the first node $ND_1$ and the second node $ND_2$ is changed. That is, a charge based on a changed amount ($V_{Sig_m}-V_{0fs}$) of the potential of the gate electrode of the drive transistor $TR_D$ (=the potential of the first node $ND_1$) is distributed according to the capacitance value between the first node $ND_1$ and the second node $ND_2$ and the capacitance value between the second node $ND_2$ and the feeding line PS2. Therefore, when a value $c_B$ ($=c_{EL}$) is a sufficiently large as compared with a value $c_A$ ($c_1+c_{gs}$), the change of the potential of the second node $ND_2$ is small. In general, the value $c_{EL}$ of the capacitor $C_{EL}$ of the light emitting portion ELP is larger than the value $c_1$ of the capacitor unit $C_1$ and the value $c_{gs}$ which is parasitic capacitance of the drive transistor $TR_D$. Hereinafter, explanation will be made, not considering potential change of the second node $ND_2$ generated by potential change of the first node $ND_1$ for convenience. The timing chart concerning the drive shown in FIG. 4 is shown without considering potential change of the second node $ND_2$ generated by potential change of the first node $ND_1$. It is also the same with respect to FIG. 11 which will be referred to.

In the above-described writing processing, the video signal $V_{Sig_m}$ is applied to the gate electrode of the drive transistor $TR_D$ in the state in which the drive voltage $V_{CC-H}$ is applied to one source/drain region of the drive transistor $TR_D$ from the power supply unit 100. Accordingly, the potential of the second node $ND_2$ is increased in [Period-TP($\mathbf{2}$)$_{6B}$] as shown in FIG. 4. The increased amount of the potential ($\Delta V$ shown in FIG. 4) will be described later. When the potential of the gate electrode of the drive transistor $TR_D$ (first node $ND_1$) is represented by $V_{gs}$ and the potential of the other source/drain regions of the drive transistor $TR_D$ is represented as $V_s$, values of $V_g$, $V_s$ will be as follows if the potential increase of the second node $ND_2$ is not considered. The potential difference between the first node $ND_1$ and the second $ND_2$, namely, the potential difference $V_{gs}$ between the gate electrode of the drive transistor $TR_D$ and the other source/drain region functioning as a source region can be represented by the following formula (3).

$$V_g=V_{Sig_m}$$

$$V_s\cong V_{Ofs}-V_{th}$$

$$V_{gs}\cong V_{Sig_m}-(V_{0fs}-V_{th}) \tag{3}$$

That is, $V_{gs}$ obtained in the writing processing with respect to the drive transistor $TR_D$ depends only on the video signal $V_{Sig_m}$ for controlling the luminance in the light emitting portion ELP, the threshold voltage $V_{th}$ of the drive transistor $TR_D$ and the voltage $V_{ofs}$ for initializing the potential of the gate electrode of the drive transistor $TR_D$. Additionally, $V_{gs}$ has no relation to a threshold voltage $V_{th-EL}$ of the light emitting portion ELP.

Subsequently, the above-described potential increase of the second node $ND_2$ in [Period-TP($\mathbf{2}$)$_{6B}$] will be explained. In the above drive method, mobility correction processing which increases the potential of the other source/drain region (namely, the potential of the second node $ND_2$) in accordance with characteristics of the drive transistor $TR_D$ (for example, the size of the mobility $\mu$ and the like) is performed together in the writing processing.

In the case where the drive transistor $TR_D$ is made of a polysilicon thin-film transistor and so on, it is difficult to avoid occurrence of variations in the mobility $\mu$ among transistors. Therefore, when the video signal $V_{Sig}$ of the same value is applied to the gate electrodes of plural drive transistors $TR_D$ having different mobilities $\mu$, difference occurs between the drain current $I_{ds}$ flowing through the drive transistor $TR_D$ having large mobility $\mu$ and the drain current $I_{ds}$ flowing through the drive transistor $TR_D$ having small mobility $\mu$. When such difference occurs, uniformity of the screen in the display device is reduced.

In the above drive method, the video signal $V_{Sig_m}$ is applied to the gate electrode of the drive transistor $TR_D$ in the state in which the drive voltage $V_{CC-H}$ is applied to one source/drain regions of the drive transistor $TR_D$ from the power supply unit 100. Accordingly, the potential of the second node $ND_2$ is increased in [Period-TP($\mathbf{2}$)$_{6B}$] as shown in FIG. 4. When the value of the mobility $\mu$ of the drive transistor $TR_D$ is large, the increased amount $\Delta V$ (potential correction value) of the potential in the other source/drain region of the drive transistor $TR_D$ (namely, the potential of the second node $ND_2$) is increased. On the other hand, when the value of the mobility $\mu$ of the drive transistor $TR_D$ is small, $\Delta V$ (potential correction value) of the potential in the other source/drain region of the drive transistor $TR_D$ is reduced. Here, the potential difference $V_{gs}$ between the gate electrode of the drive transistor $TR_D$ and the other source/drain region functions as the source region can be transformed from the formula (3) into the following formula (4).

$$V_{gs}\cong V_{Sig_m}-(V_{0fs}-V_{th})-\Delta V \tag{4}$$

Full time ($t_0$) of given time for executing the writing processing ([Period-TP($\mathbf{2}$)$_{6B}$] in FIG. 4) may be determined according to design of the display element and the display device. The full time $t_0$ of [Period-TP($\mathbf{2}$)$_{6B}$] is determined so that the potential ($V_{0fs}-V_{th}$)+$\Delta V$) in the other source/drain region of the drive transistor $TR_D$ at this time satisfies the following formula (2'). The light emitting portion ELP does not emit light in [Period-TP($\mathbf{2}$)$_{6B}$]. According to the mobility correction processing, correction of variations in a coefficient "k" ($\equiv$½)·(W/L)·$C_{ox}$) is performed at the same time.

$$(V_{0fs}-V_{th})+\Delta V)<(V_{th-EL}+V_{Cat}) \tag{2'}$$

[Period-TP($2$)$_{6C}$] (Refer to FIG. 4, FIG. 6E)

According to the above operation, the steps (a), (b) are completed. After that, the following step is performed from [Period-TP($2$)$_{6C}$]. That is, while maintaining the state in which the drive voltage $V_{CC-H}$ is applied to one source/drain region of the drive transistor $TR_D$ from the power supply unit 100, the scanning line $SCL_m$ is made low in level, the write transistor $TR_W$ is turned off and the first node $ND_1$, namely, the gate electrode of the drive transistor $TR_D$ is made in the floating state. Accordingly, as a result of the above, the potential of the second node $ND_2$ is increased.

As described above, the gate electrode of the drive transistor $TR_D$ is in the floating state as well as there exists the capacitor unit C1, therefore, a phenomenon similar to the phenomenon in a so-called bootstrap circuit is generated at the gate electrode of the drive transistor $TR_D$ and the potential of the first node $ND_1$ is also increased. As a result, the potential difference $V_{gs}$ between the gate electrode of the drive transistor $TR_D$ and the other source/drain region functions as the source region maintains the value of the formula (4).

Since the potential of the second node $ND_2$ is increased and exceeds ($V_{th-EL}+V_{Cat}$), the light emitting portion ELP starts emitting light (refer to FIG. 6F). At this time, electric current flowing into the light emitting portion ELP is the drain current $I_{ds}$ flowing from the drain region to the source region of the drive transistor $T_{RD}$, therefore, it can be represented by the formula (1). Here, the formula (1) can be transformed into the following formula (5) from the formula (1) and the formula (4).

$$I_{ds}=k\cdot\mu\cdot(V_{Sig_m}-V_{0fs}-\Delta V)^2 \quad (5)$$

Therefore, for example, when $V_{0fs}$ is set to 0V, the current $I_{ds}$ flowing through the light emitting portion ELP is in proportion to a square of a value obtained by subtracting a value of the potential correction value ΔV due to the mobility μ of the drive transistor $T_{RD}$ from a value of the video signal $V_{Sig_m}$ for controlling the luminance in the light emitting portion ELP. In other words, the current $I_{ds}$ flowing through the light emitting portion ELP does not depend on the threshold voltage $V_{th-EL}$ of the light emitting portion ELP and the threshold voltage $V_{th}$ of the drive transistor $TR_D$. That is, the light emitting amount (luminance) of the light emitting portion ELP is not affected by the threshold voltage $V_{th-EL}$ of the light emitting portion ELP and the threshold voltage $V_{th}$ of the drive transistor $TR_D$. The luminance of the (m, n)th display element 10 has a value corresponding to such current $I_{ds}$.

The larger the mobility μ of the drive transistor $TR_D$ is, the larger the potential correction value ΔV becomes, therefore, the value of $V_{gs}$ in the left side of the formula (4) is reduced. Therefore, the value of $(V_{Sig_m}-V_{0fs}-\Delta V)^2$ is reduced even when the value of the mobility μ is large in the formula (5), as a result, it is possible to correct variations of the drain current $I_{ds}$ due to variations of the mobility μ of the drive transistor $TR_D$ (further, variations of "k"). Accordingly, variations of the luminance of the light emitting portion ELP due to variations of the mobility μ (further, variations of "k") can be corrected.

Then, the light emitting state is continued to the (m+m'−1) th horizontal scanning period. The end of the (m+m'−1) th horizontal scanning period corresponds to the end of [Period-TP($2$)$_{-1}$]. Here, "m'" is a given value in the display device which satisfies the relation of 1<m'<M. In other words, the light emitting portion ELP is driven from the beginning of [Period-TP($2$)$_{6C}$] to just before the (m+m')th horizontal scanning period $H_{m+m'}$, and this period corresponds to the light emitting period.

The relation among the potential of the feeding line PS1, the potential of the second node $ND_2$ and the drain current $I_{ds}$ flowing through the drive transistor $TR_D$ will be explained with reference to FIGS. 7A to 7D.

Figure 7A:
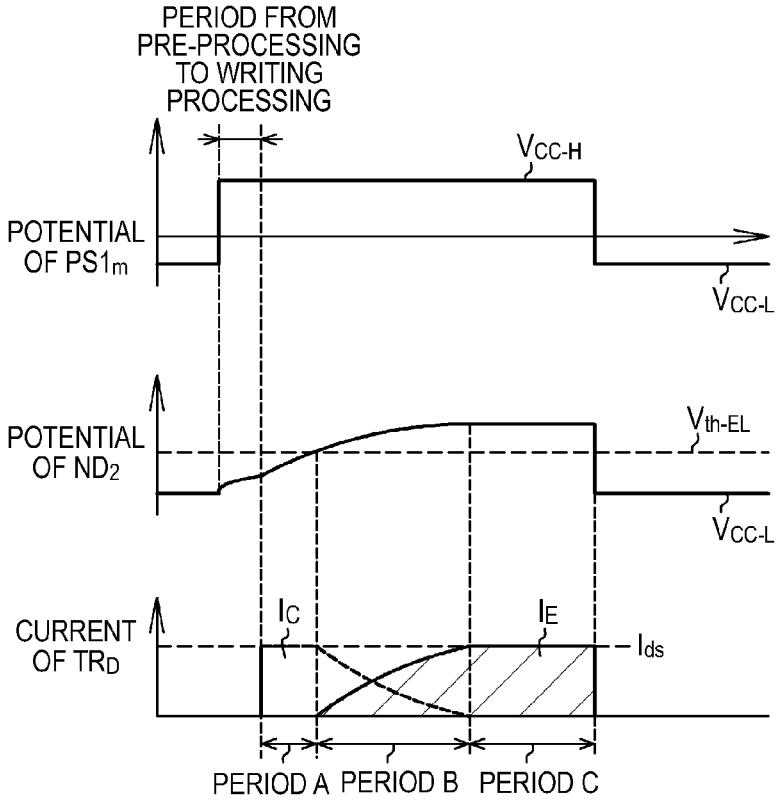
FIG. 7A is a schematic chart for explaining the relation among a potential of a feeling line, a potential of a second node and drain current flowing through the drive transistor.

As shown in FIG. 7A, when the potential of the feeling line $PS1_m$ is switched from the second node initialization voltage $V_{CC-L}$ to the drive voltage $V_{CC-H}$, the drain current $I_{ds}$ flows through the drive transistor $TR_D$ except the period from the pre-processing to the writing processing explained with reference to FIG. 4. Therefore, the potential of the second node $ND_2$ is increased after the writing processing is completed.

Figure 7B:
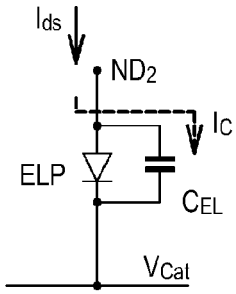
FIGS. 7B, 7C and 7D are schematic diagrams for explaining the flow of drain current in a period A, a period B and a period C shown in FIG. 7A.
Figure 7C:
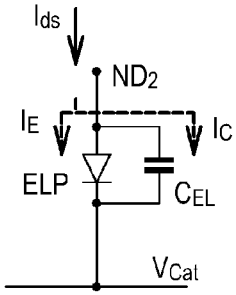
Figure 7D:
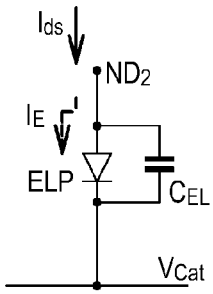

At this time, in a period "A" during which the potential of the second node $ND_2$ does not exceed the threshold voltage $V_{th-EL}$ of the light emitting portion ELP, the drain current $I_{ds}$ exclusively flows into the capacitor $C_{EL}$ of the light emitting portion ELP (refer to FIG. 7B). A code $I_C$ denotes current flowing into the capacitor $C_{EL}$ in the drain current $I_{ds}$, and a code $I_E$ denotes current flowing into the light emitting portion ELP in the drain current $I_{ds}$. In a period "B" during which the potential of the second node $ND_2$ reaches a fixed value after exceeding the threshold voltage $V_{th-EL}$ of the light emitting portion ELP, the drain current $I_{ds}$ flows into the capacitor $C_{EL}$ as well as flows into the light emitting portion ELP (refer to FIG. 7C). Furthermore, in a period "C" after the potential of the second node $ND_2$ reaches the fixed value, the drain current $I_{ds}$ exclusively flows into the light emitting portion ELP (refer to FIG. 7D). The current $I_C$ flowing into the capacitor $C_{EL}$ does not contribute to the light emission. Therefore, part of the drain current $I_{ds}$ which contributes to the light emission (charge amount) is a portion to which hatching is performed in FIG. 7A.

Figure 8:
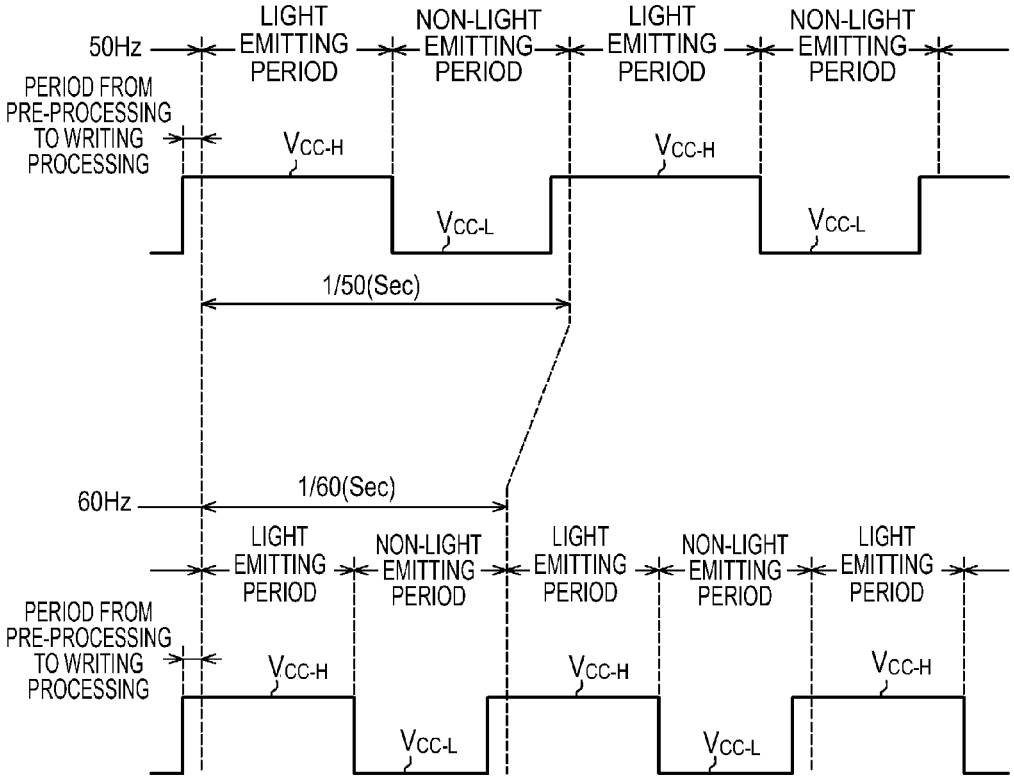
FIG. 8 shows schematic timing charts for explaining the relation between voltage applied to the feeding line and a light emitting period and a non-light emitting period when a frame frequency is 50 Hz and the relation between voltage applied to the feeding line and the light emitting period and the non-light emitting period when the frame frequency is 60 Hz.

Here, the difference generated in the current amount flowing into the light emitting portion ELP in the case where the frame frequency is relatively low (for example, 50 Hz) and in the case where the frame frequency is relatively high (for example, 60 Hz) will be considered. As shown in FIG. 8, when the frame frequency is increased, the length obtained by adding the light emitting period to the non-light emitting period is reduced. Therefore, when the frame frequency is increased, the period in which the drive voltage $V_{CC-H}$ is applied to the feeding line $PS1_m$ is also reduced in general.

Figure 9A:
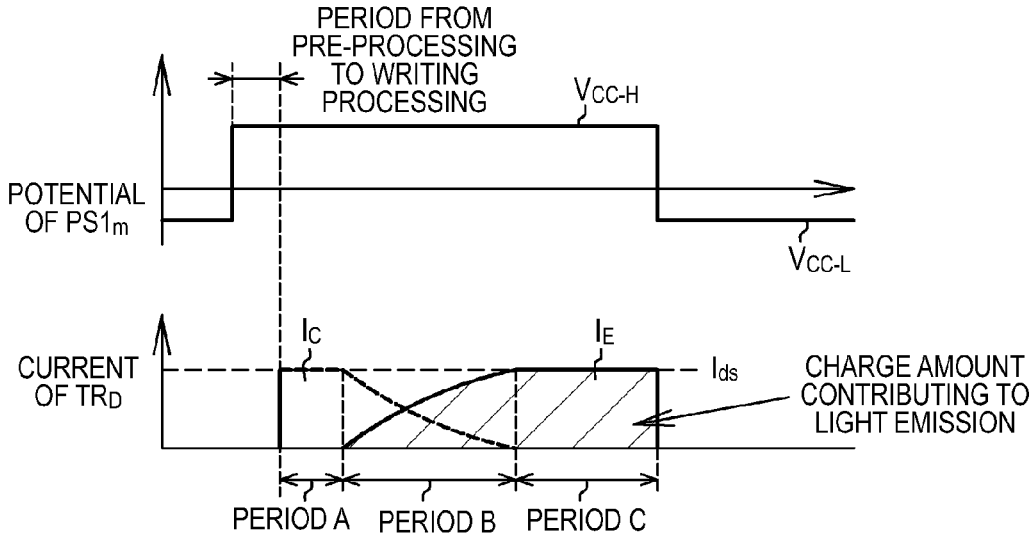
FIG. 9A is a schematic chart for explaining a portion which contributes to light emission in the drain current flowing through the drive transistor when the frame frequency is relatively low.
Figure 9B:
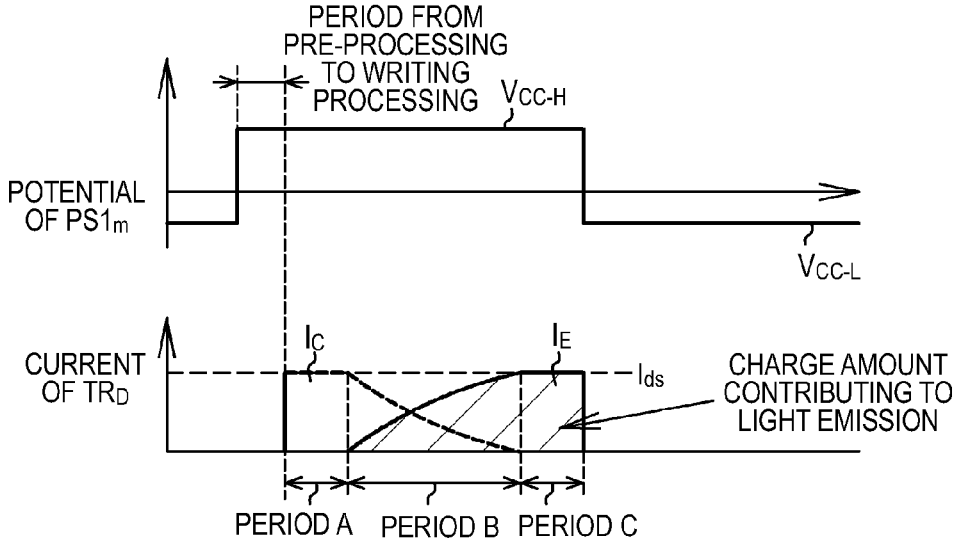
FIG. 9B is a schematic chart for explaining a portion which contributes to light emission in the drain current flowing through the drive transistor when the frame frequency is relatively high.

FIG. 9A is a schematic chart for explaining a portion which contributes to light emission in the drain current $I_{ds}$ flowing through the drive transistor $TR_D$ when the frame frequency is relatively low (50 Hz). FIG. 9B is a schematic chart for explaining a portion which contributes to light emission in the drain current $I_{ds}$ flowing through the drive transistor $TR_D$ when the frame frequency is relatively high (60 Hz). When the value of the video signal $V_{Sig}$ is a fixed, the length of the period "A" and the length of the period "B" are fixed regardless of the value of the frame frequency.

Figure 10:
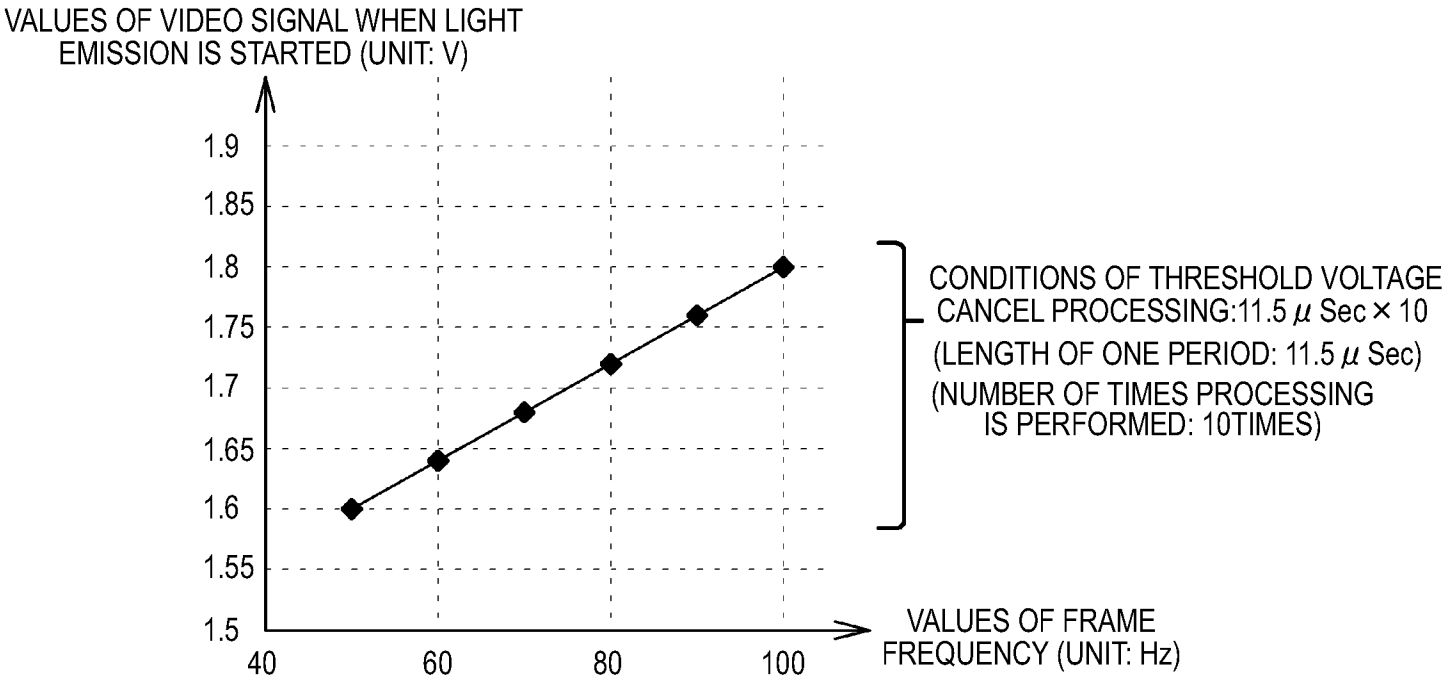
FIG. 10 is a schematic graph for explaining the relation between the frame frequency and the value of a video signal when the display device starts emitting light in the case where conditions of threshold voltage cancel processing are maintained.

Accordingly, the higher the frame frequency is, the shorter the length of the period "C" becomes. Even when the value of the video signal $V_{Sig}$ is fixed, the portion which contributes to light emission in the drain current $I_{ds}$ is reduced as the frame frequency is increased. Accordingly, the voltage of the video signal $V_{Sig}$ (voltage of black display) which is visible when the display device starts emitting light will be changed according to the value change of the frame frequency. FIG. 10 shows values of the video signal $V_{Sig}$ which is visible when the display device starts emitting light when the frame frequency is changed while maintaining conditions of the threshold voltage cancel processing (actual conditions will be described later). As shown in FIG. 10, it can be seen that the value of the video signal $V_{Sig}$ in a so-called black level is increased as the frame frequency is increased.

Figure 11:
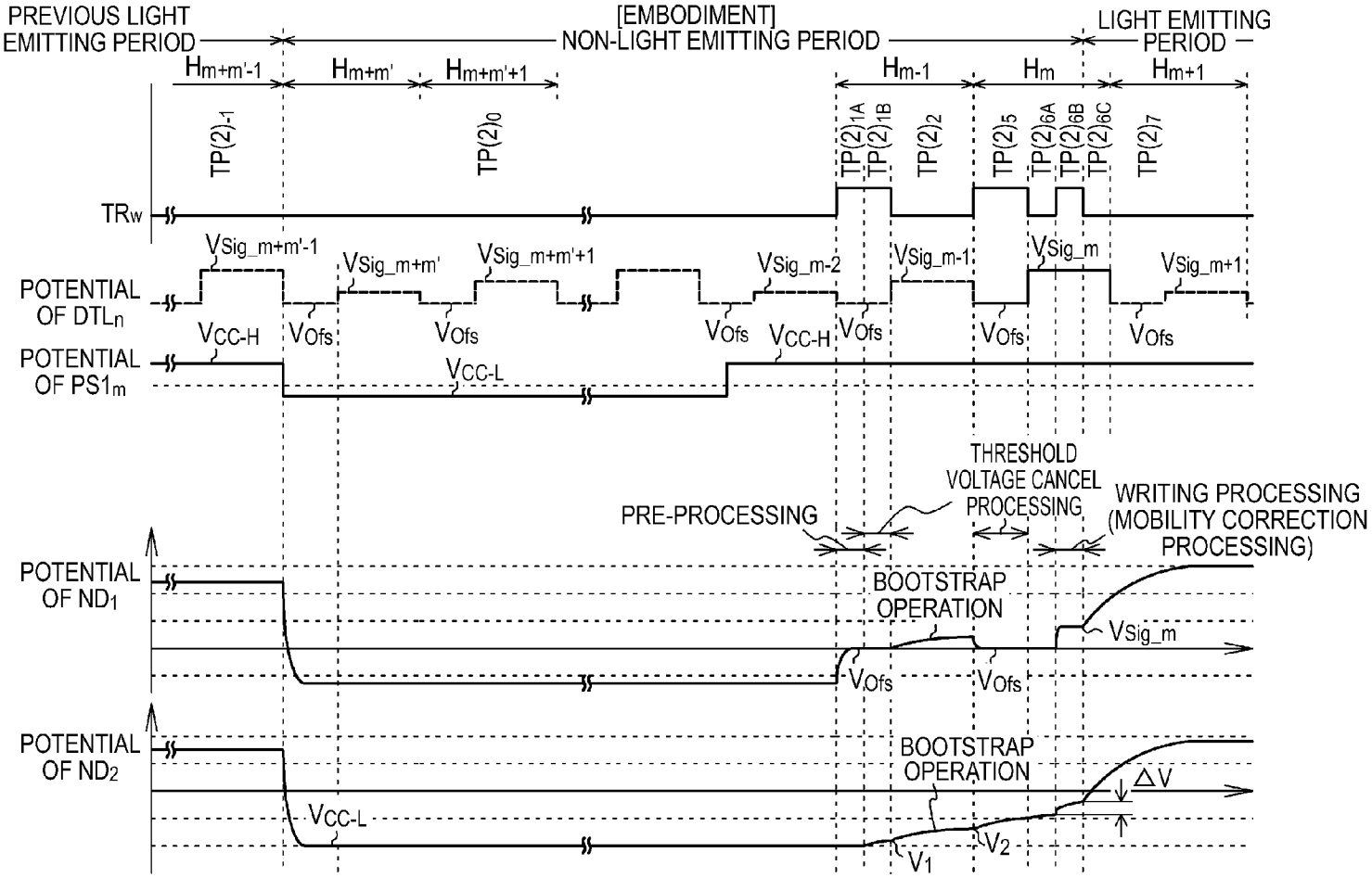
FIG. 11 is a schematic view of a timing chart of driving of the display element when the sum of lengths of periods in which threshold voltage cancel processing is performed is shorted.

Advantages obtained by reducing the sum of lengths of periods during which the threshold voltage cancel processing is performed will be explained with reference to FIG. 11. FIG. 11 is a timing chart obtained when timings of initialization and the like are delayed by one horizontal scanning period with respect to the timing chart of FIG. 4. In operations shown in FIG. 11, the potential increase of the second node $ND_2$ in the threshold voltage cancel processing in [Period-TP(2)$_3$] shown in FIG. 4 is not generated. The potential of the second node $ND_2$ in the threshold voltage cancel processing in [Period-TP(2)$_4$] shown in FIG. 4 is not increased, either. Therefore, the voltage difference between the first node $ND_1$ and the second node $ND_2$ after the writing processing is performed in [Period-TP(2)$_{6B}$] becomes larger than the difference when performing the operation shown in FIG. 4. That is, even when the value of the video signal $V_{Sig}$ is the same, the value of the drain current $I_{ds}$ in [Period-TP(2)$_7$] is increased by reducing the sum of lengths of periods during which the threshold voltage cancel processing is performed.

Figure 12:
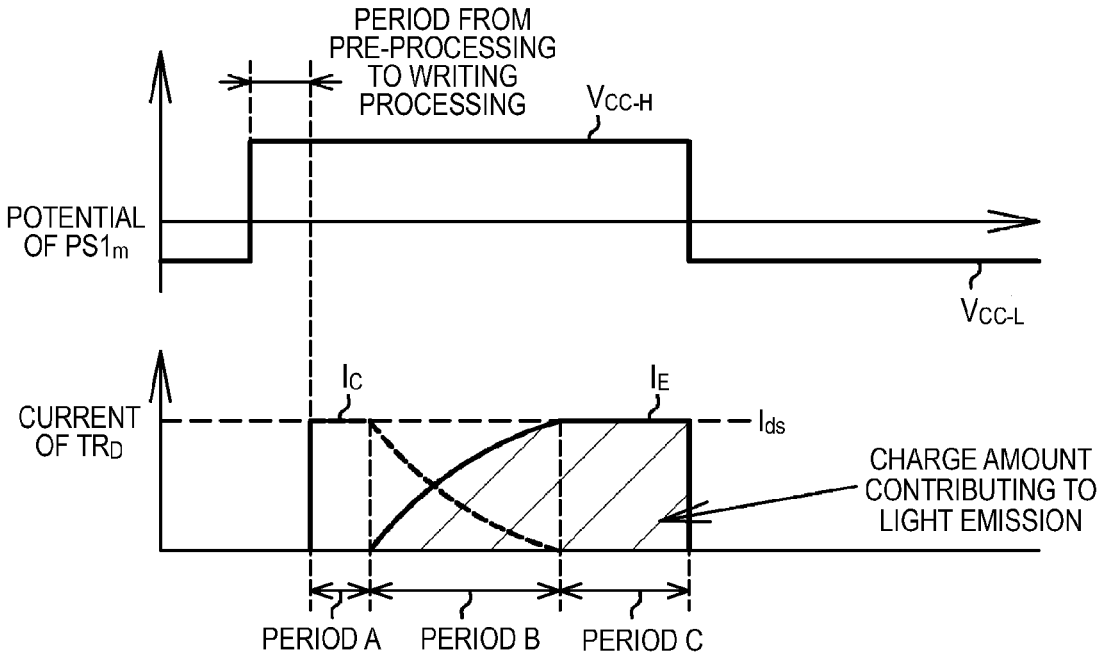
FIG. 12 is a schematic chart for explaining a portion which contributes to light emission in the drain current flowing through the drive transistor when the frame frequency is relatively high and the sum of lengths of periods in which the threshold voltage cancel processing is performed is shorted.

Therefore, when the display device is so driven as to reduce the sum of lengths of periods during which the threshold voltage cancel processing is performed, the value of the drain current $I_{ds}$ is increased. The length of the period "C" is relatively reduced when the frame frequency is increased, however, the value of the drain current $I_{ds}$ is increased when the drive device is so driven as to reduce the sum of lengths of periods during which the threshold voltage cancel processing is performed. FIG. 12 is a diagram corresponding to FIG. 9B, which is a schematic diagram for explaining the portion which contributes to light emission in the drain current $I_{ds}$ flowing through the drive transistor $TR_D$ when the sum of lengths of periods during which the threshold voltage cancel processing is performed is reduced in the case where the frame frequency is relatively high. When the value of the drain current $I_{ds}$ in FIG. 12 is so set that the area of the hatched portion shown in FIG. 9A is the same as the area of a hatched portion shown in FIG. 12, the phenomenon in which the value of the video signal $V_{Sig}$ in the so-called black display is increased as the frame frequency is increased can be cancelled.

The basic principle of the drive method of the display device according to the embodiment has been explained as the above. Next, a configuration and the drive method of the display device according to the embodiment will be explained in more detail with reference to FIG. 13 to FIG. 24.

Figure 13:
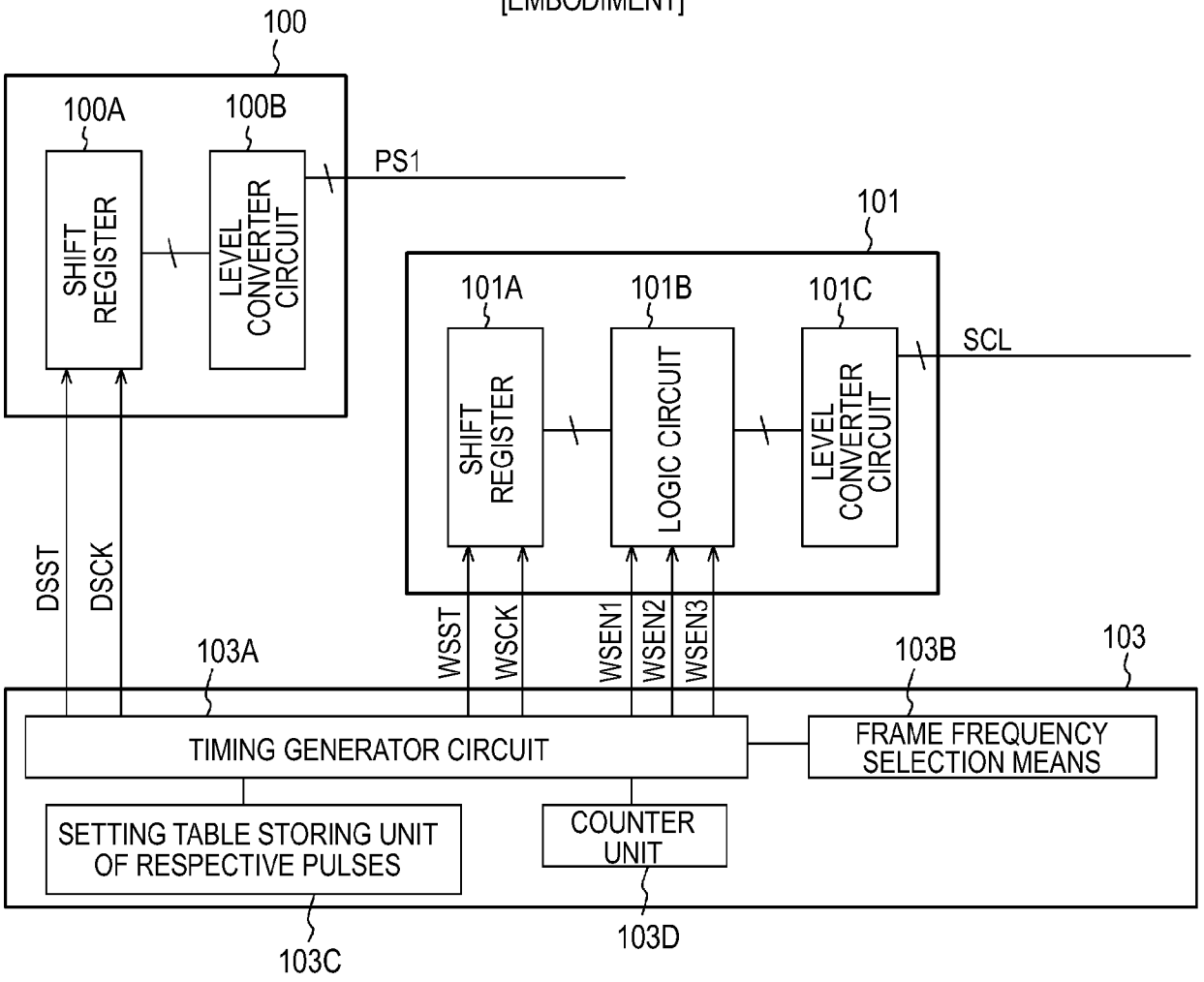
FIG. 13 is a schematic configuration diagram for explaining configurations of a power supply unit, a scanning circuit and a control circuit.

FIG. 13 is a schematic configuration diagram for explaining a configuration of the power supply unit 100, the scanning circuit 101 and the control circuit 103.

The control circuit 103 includes a timing generator circuit 103A, a frame frequency selection unit 103B, a setting table storing unit of respective pulses 103C and a counter unit 103D. To the timing generator circuit 103A, a signal based on the value of the selected frame frequency is inputted from the frame frequency selection unit 103B. The timing generator circuit 103A refers to the setting table storing unit of respective pulses 103C corresponding to the value of the frame frequency. Then, operations of the scanning circuit 101 and the power supply unit 100 are controlled by outputting later-described various signals based on the obtained set value and a signal from the counter unit 103D.

Figure 14A:
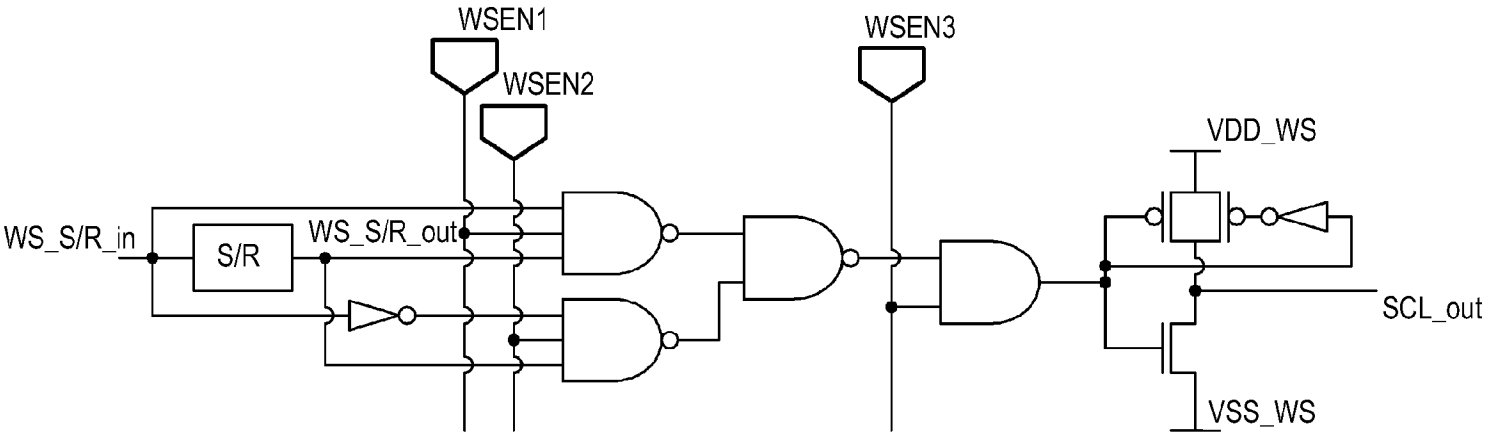
FIG. 14A is a schematic circuit diagram for explaining a configuration of part of the scanning circuit corresponding to one scanning line.

The power supply unit 100 includes a shift register unit 100A and a level converter circuit 100B. The scanning circuit 101 includes a shift register unit 101A, a logic circuit unit 101B and a level converter circuit 101C. A configuration of part of the scanning circuit 101 corresponding to one scanning line SCL is shown in FIG. 14A. A configuration of part of the power supply unit 100 corresponding to one feeding line PS1 is shown in FIG. 14B.

The control circuit 103 applies a start pulse DSST and a clock signal DSCK to the power supply unit 100 at predetermined timings. The control circuit 103 also applies a start pulse WSST, a clock signal WSCK, a first enable signal WSEN1, a second enable signal WSEN2 and a third enable signal WSEN3 to the scanning circuit 101. The start pulse DSST is applied to the first stage of the shift register unit 100A of the power supply unit 100 and the start pulse WSST is applied to the first stage of the shift register unit 101A of the scanning circuit 101. These signals are not shown in FIG. 14A and FIG. 14B. In FIG. 14A, notation of the clock signal WSCK is omitted. Similarly, notation of the clock signal DSCK is omitted in FIG. 14B.

Figure 14B:
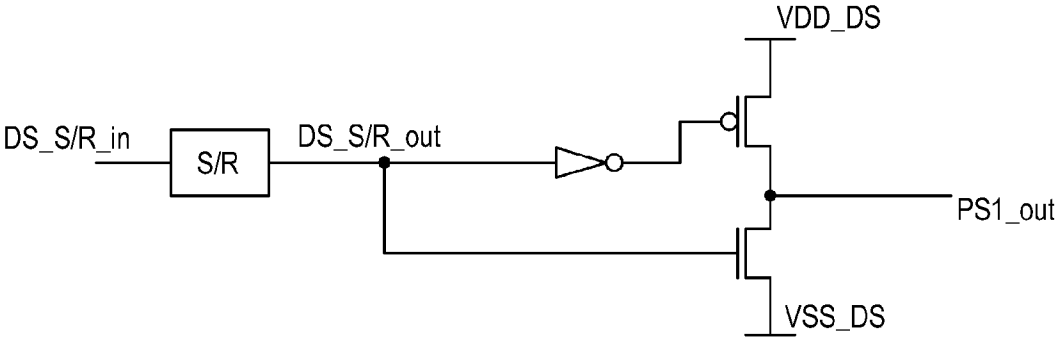
FIG. 14B is a schematic circuit diagram for explaining a configuration of part of the power supply unit corresponding to one feeding line.

Codes $V_{DD_WS}$, $V_{SS_WS}$ shown in FIG. 14A and codes $V_{DD_Ds}$, $V_{SS_DS}$ shown in FIG. 14B are power supply voltages to be applied to level shift circuits. A code $SCL_{}_{out}$ shown in FIG. 14A represents an output signal to be applied to the scanning line SCL and a code $PS1_{}_{out}$ shown in FIG. 14B represents an output signal to be applied to the feeding line PS1. Codes $WS_{}_{S/R_in}$, $WS_{}_{S/R_out}$ shown in FIG. 14A are respectively an input signal and an output signal of the shift register unit of the scanning circuit 101. Similarly, codes $DS_{}_{S/R_in}$, $DS_{}_{S/R_out}$ shown in FIG. 14B are respectively an input signal and an output signal of the shift register unit of the power supply unit 100.

Figure 15:
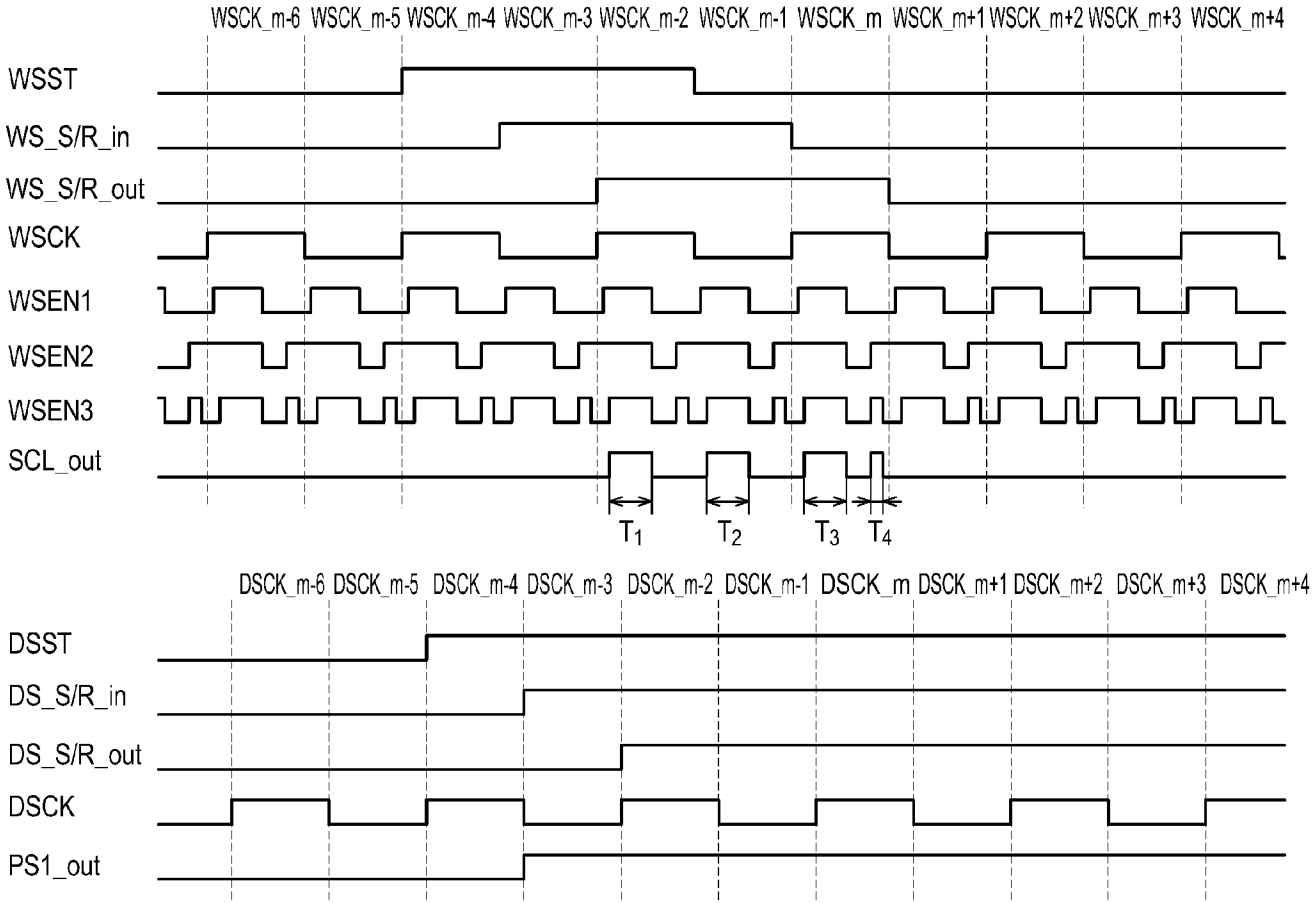
FIG. 15 is a schematic timing chart for explaining operations in the control circuit, the scanning circuit and the power supply unit.

FIG. 15 is a schematic timing chart for explaining operations of the control circuit 103, the scanning circuit 101 and the power supply units 100. FIG. 15 is the timing chart corresponding to FIG. 4, and a period $T_1$ shown in FIG. 15 corresponds to the period from the beginning of [Period-TP(2)$_{1A}$] to the end of [Period-TP(2)$_{1B}$]. Periods $T_2$, $T_3$ respectively correspond to [Period-TP(2)$_3$] and [Period-TP(2)$_5$]. A period $T_4$ shown in FIG. 15 corresponds to [Period-TP(2)$_{6B}$] shown in FIG. 4.

Figure 16:
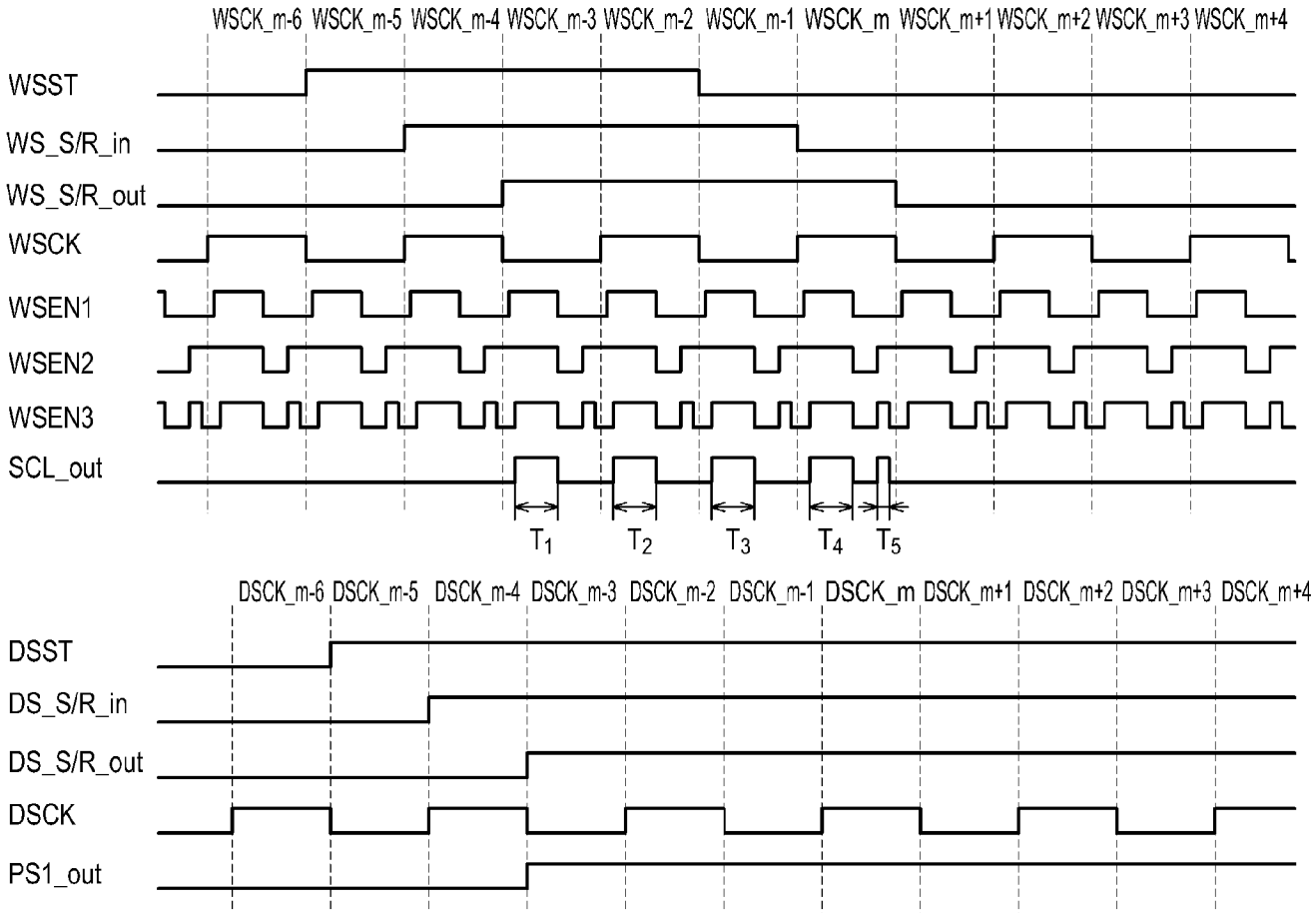
FIG. 16 is a schematic timing chart for explaining operations in the control circuit, the scanning circuit and the power supply unit.

FIG. 16 is also a schematic timing chart for explaining operations of the control circuit 103, the scanning circuit 101 and the power supply unit 100. FIG. 16 is the timing chart in which the timing of initialization is performed earlier than the case of FIG. 15 by one horizontal scanning period as well as the number of times the threshold voltage cancel processing is performed is increased once. In the circuit configuration explained with reference to FIG. 13 and FIGS. 14A, 14B, it is possible to easily adjust the number of times the threshold voltage cancel processing is performed and the length of the period in which one threshold voltage cancel processing is performed by changing various signals supplied from the control circuit 103.

Figure 17:
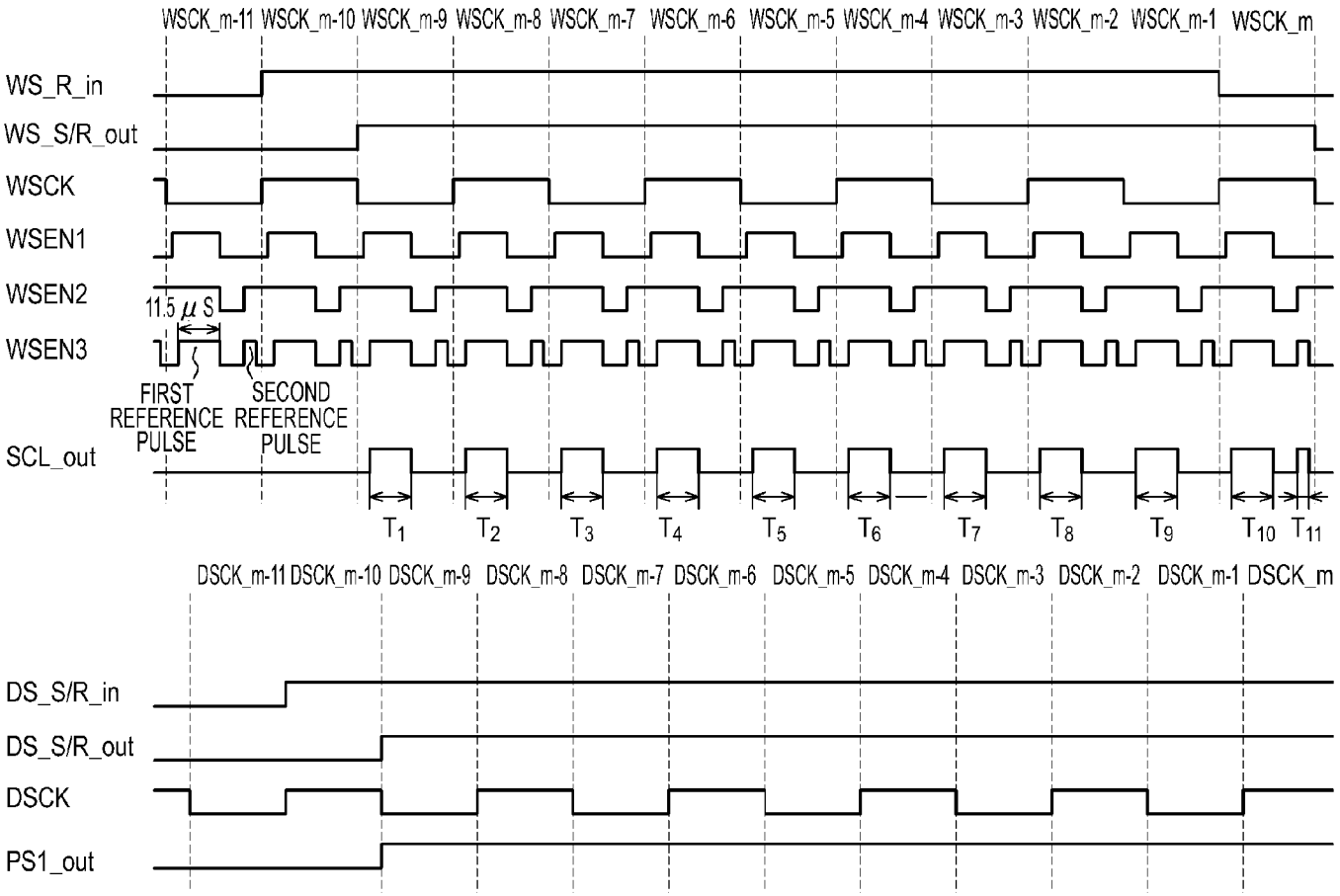
FIG. 17 is a schematic timing chart for explaining operations in the control circuit, the scanning circuit and the power supply unit.

Data shown in FIG. 10 was measured by performing initialization to the writing processing in a timing chart shown in FIG. 17 and the display device is driven by respective frame frequencies. In periods $T_1$ to $T_{10}$ shown in FIG. 17, the threshold voltage cancel processing is performed, and in a period $T_{11}$ shown in FIG. 17, the writing processing is performed. The length of each period of the periods $T_1$ to $T_{10}$ is prescribed by a first reference pulse in the third enable signal WSEN3, which is set to 11.5 ms. The length of the period $T_{11}$ prescribing the writing period is prescribed by a second reference pulse in the third enable signal WSEN3. In the embodiment, the second reference pulse is set to a fixed length regardless of the frame frequency.

Figure 18:
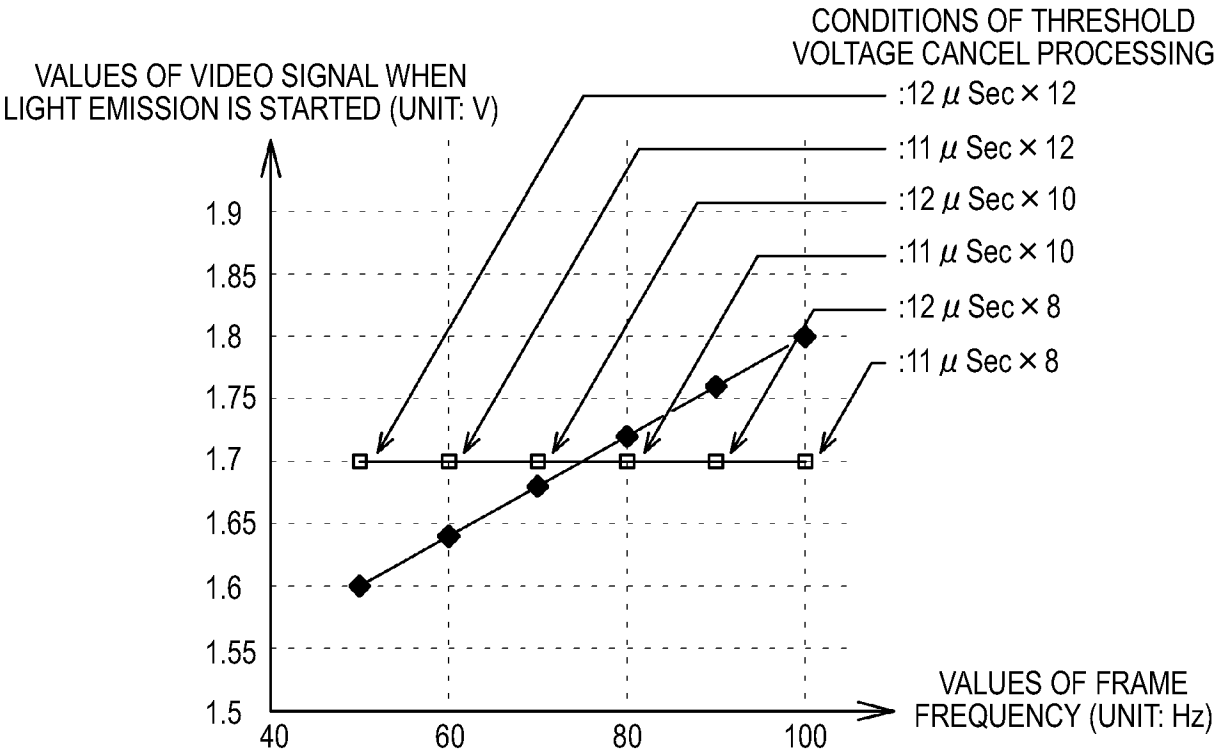
FIG. 18 is a schematic graph for explaining the relation between the frame frequency and the value of the video signal when the display device starts emitting light in the case where conditions of threshold voltage cancel processing are changed according to the frame frequency.

FIG. 18 is a graph corresponding to FIG. 17, which is a schematic graph for explaining the relation between the frame frequency and the value of video signal $V_{Sig}$ when light emission is started in the display device in the case where the condition of the threshold voltage cancel processing is changed according to the frame frequency.

When the display device is driven by a given frame frequency FR, the number of times the threshold voltage cancel processing is performed is represented as P(FR) and the length of the period in which one threshold voltage cancel processing is performed is represented as TU(FR) in the step (a). When the first frame frequency is represented as $FR_1$ and the second frame frequency which is higher than the first frame frequency is represented as $FR_2$, the display device is so controlled as to satisfy $TU(FR_1)\cdot P(FR_1)>TU(FR_2)\cdot P(FR_2)$ as described later.

Figure 19:
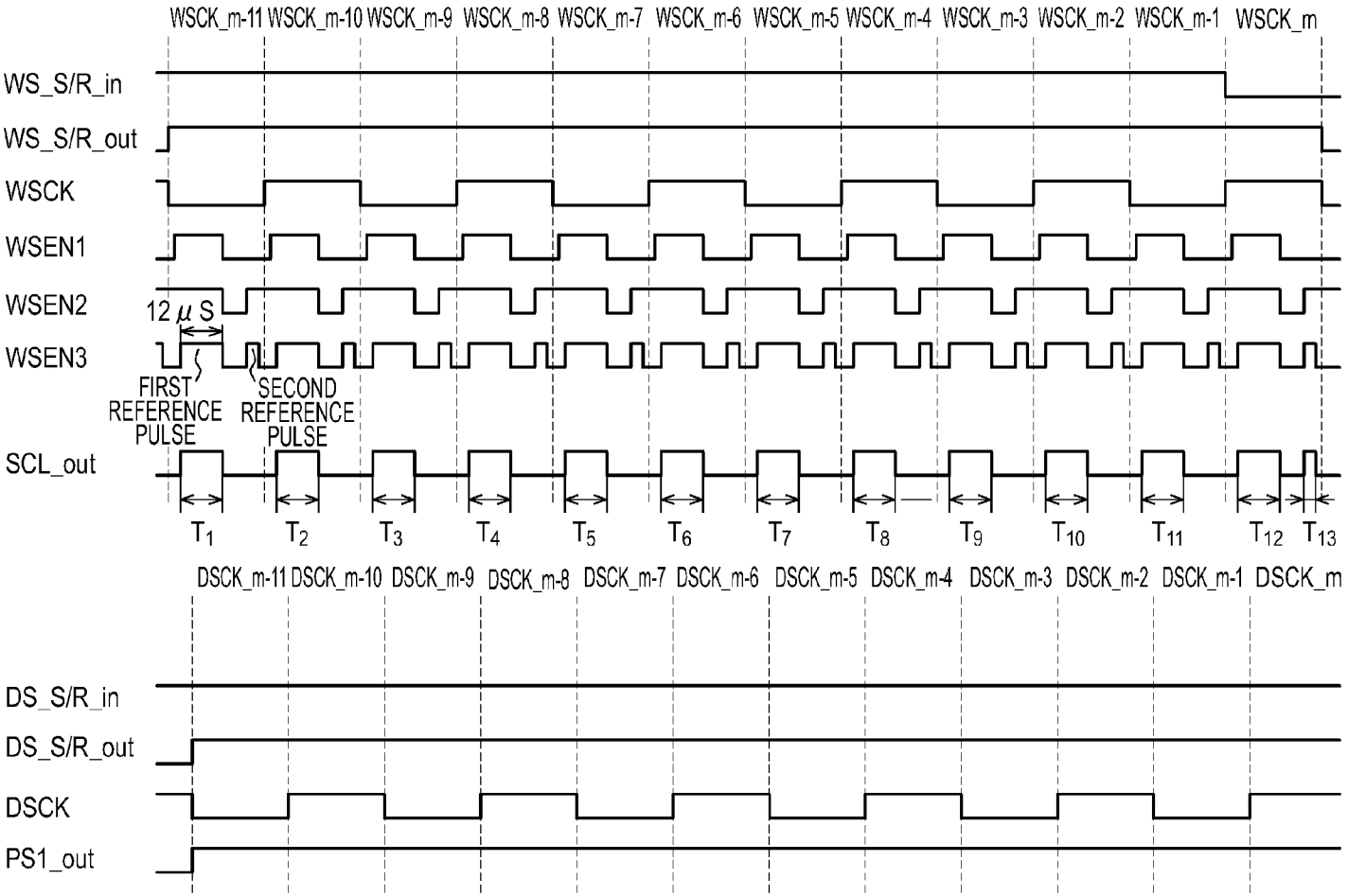
FIG. 19 is a schematic timing chart for explaining the drive method according to the embodiment when the frame frequency is 50 Hz.

A timing chart obtained when the frame frequency is 50 Hz is shown in FIG. 19. At this time, the first reference pulse in the third enable signal WSEN3 is set to 12 sm, and threshold voltage cancel processing is performed in periods $T_1$ to $T_{12}$ shown in FIG. 19. At this time, TU(50)·P(50)=12·12=144 ms.

Figure 20:
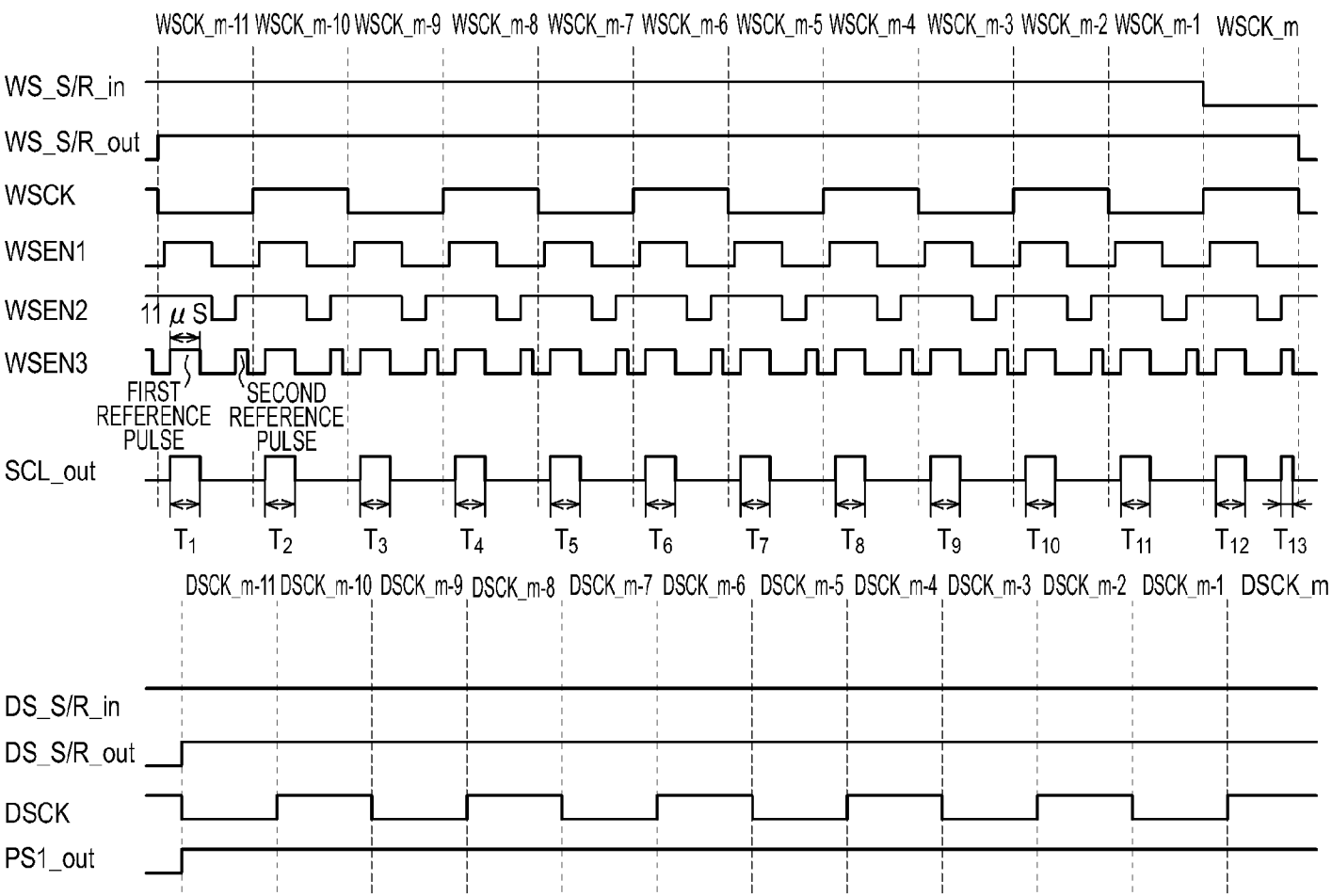
FIG. 20 is a schematic timing chart for explaining the drive method according to the embodiment when the frame frequency is 60 Hz.

A timing chart obtained when the frame frequency is 60 Hz is shown in FIG. 20. At this time, the first reference pulse in the third enable signal WSEN3 is set to 11 sm, and threshold voltage cancel processing is performed in periods $T_1$ to $T_{12}$ shown in FIG. 20. At this time, TU(60)·P(60)=11·12=132 ms.

Figure 21:
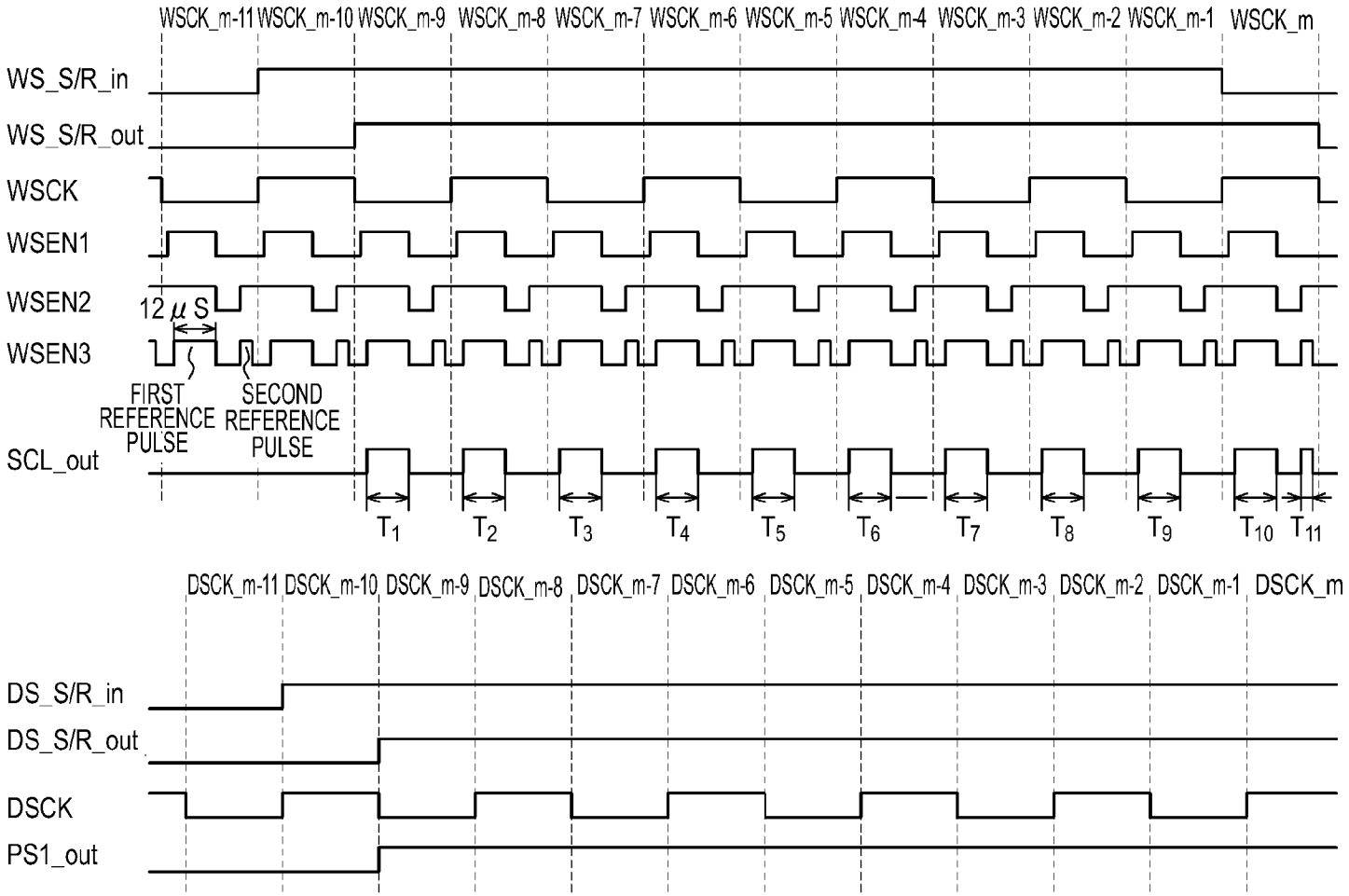
FIG. 21 is a schematic timing chart for explaining the drive method according to the embodiment when the frame frequency is 70 Hz.

A timing chart obtained when the frame frequency is 70 Hz is shown in FIG. 21. At this time, the first reference pulse in the third enable signal WSEN3 is set to 12 sm, and threshold voltage cancel processing is performed in periods $T_1$ to $T_{10}$ shown in FIG. 21. At this time, TU(70)·P(70)=12·10=120 ms.

Figure 22:
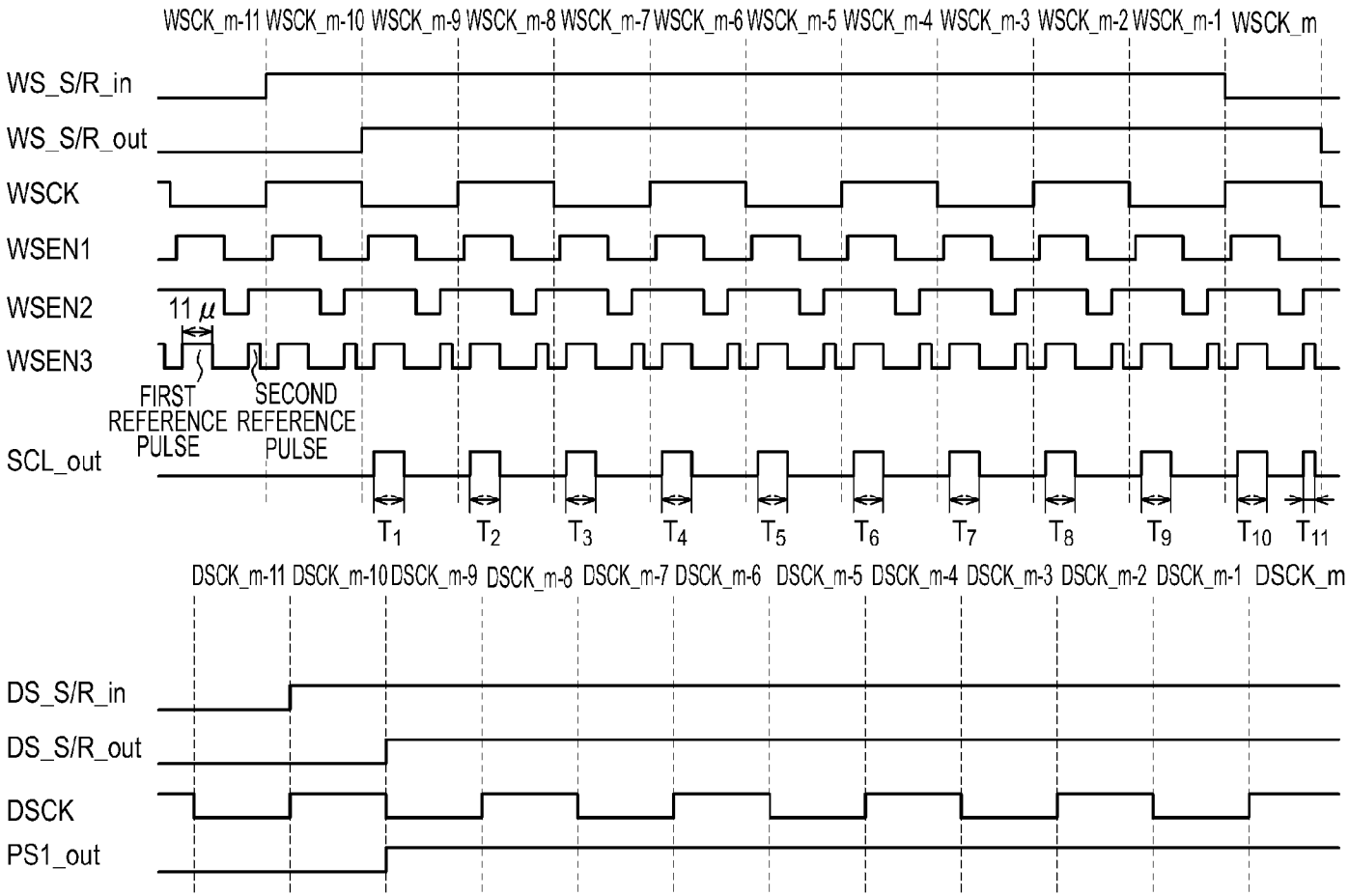
FIG. 22 is a schematic timing chart for explaining the drive method according to the embodiment when the frame frequency is 80 Hz.

A timing chart obtained when the frame frequency is 80 Hz is shown in FIG. 22. At this time, the first reference pulse in the third enable signal WSEN3 is set to 11 sm, and threshold voltage cancel processing is performed in periods $T_1$ to $T_{10}$ shown in FIG. 22. At this time, TU(80)·P(80)=11·10=110 ms.

Figure 23:
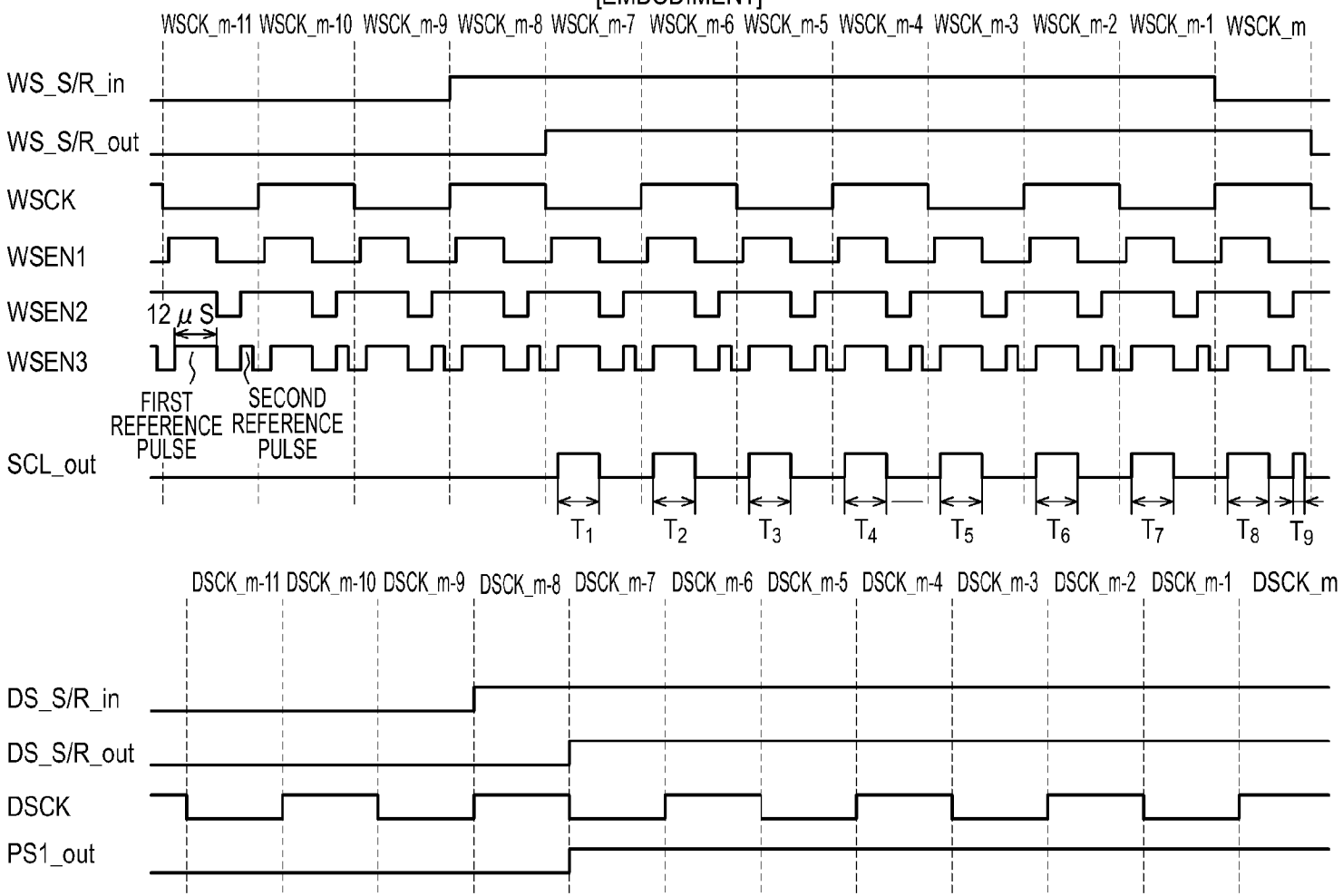
FIG. 23 is a schematic timing chart for explaining the drive method according to the embodiment when the frame frequency is 90 Hz.

A timing chart obtained when the frame frequency is 90 Hz is shown in FIG. 23. At this time, the first reference pulse in the third enable signal WSEN3 is set to 12 sm, and threshold voltage cancel processing is performed in periods $T_1$ to $T_8$ shown in FIG. 23. At this time, TU(90)·P(90)=12·8=96 ms.

Figure 24:
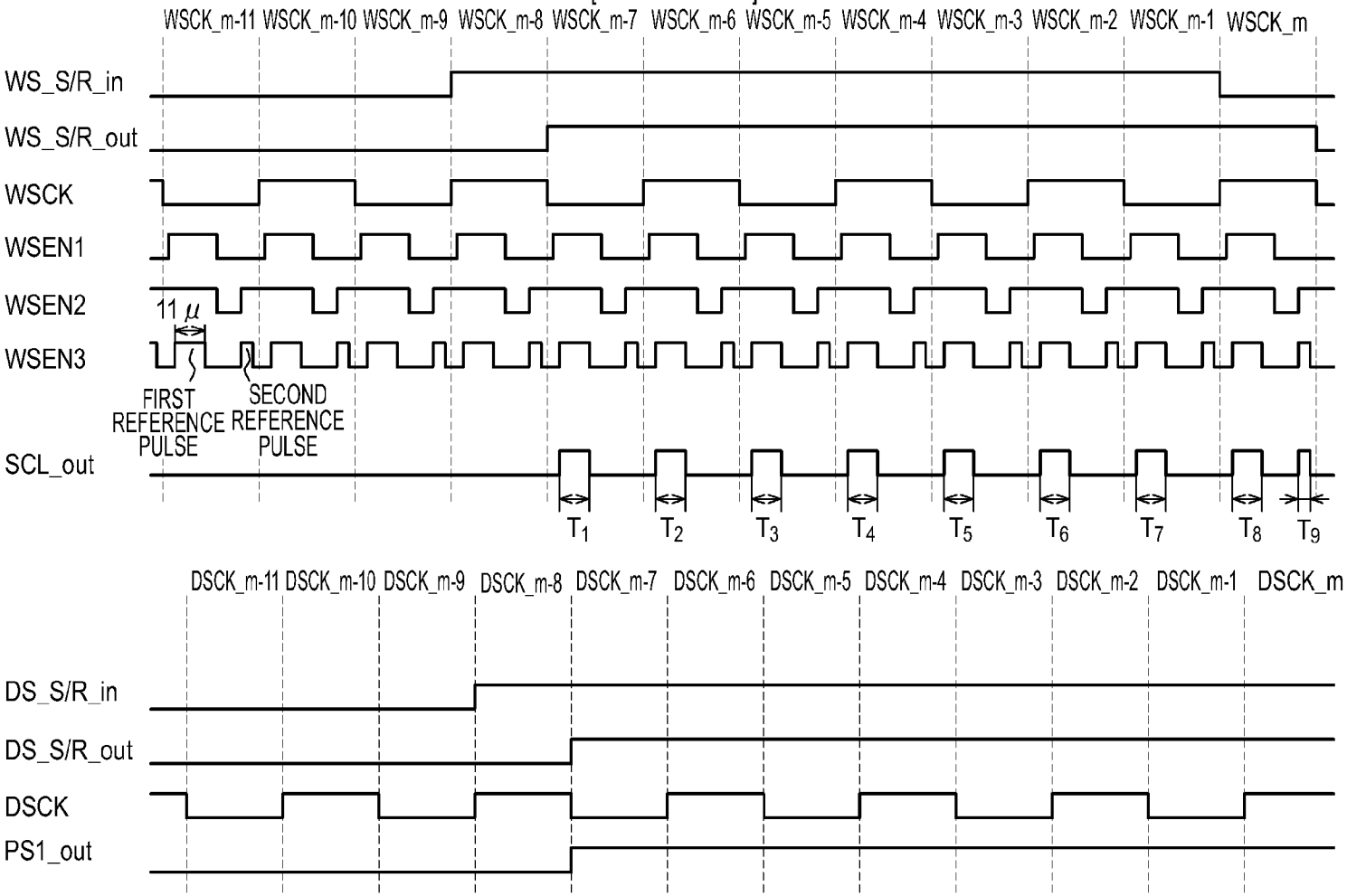
FIG. 24 is a schematic timing chart for explaining the drive method according to the embodiment when the frame frequency is 100 Hz.
Figure 25:
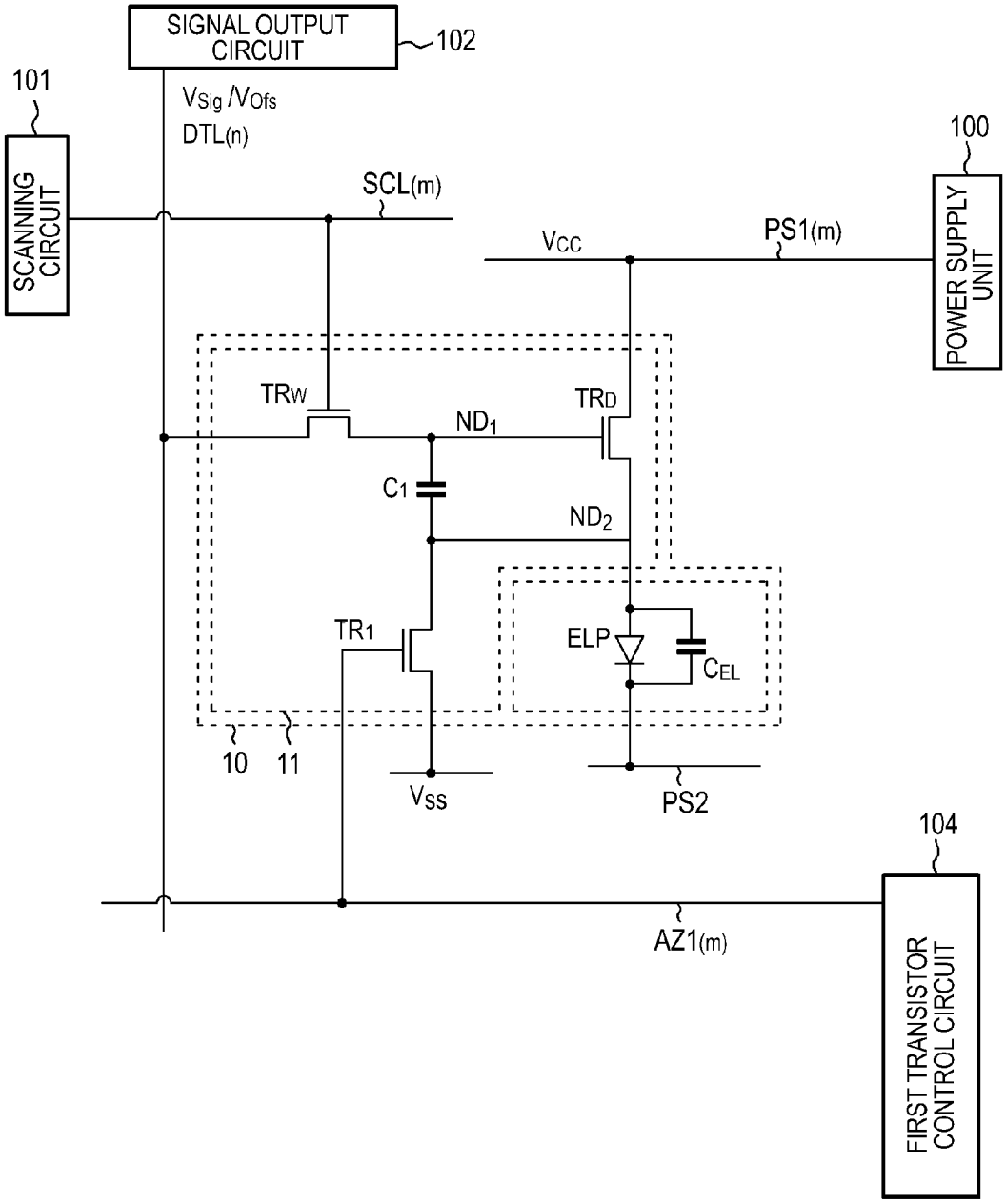
FIG. 25 is an equivalent circuit diagram of the display element including the drive circuit.

A timing chart obtained when the frame frequency is 100 Hz is shown in FIG. 24. At this time, the first reference pulse in the third enable signal WSEN3 is set to 11 sm, and threshold voltage cancel processing is performed in periods $T_1$ to $T_8$ shown in FIG. 23. At this time, TU(100)·P (100)=11·8=88 ms.

As described above, the condition of the threshold voltage cancel processing is changed according to the frame frequency, thereby adjusting values of the video signal $V_{Sig}$ which is seen when the display device emits light to a fixed value regardless of the value of the frame frequency. Therefore, it is not necessary to adjust values of the video signal according to the frame frequency, and pictures can be displayed in respective frame frequencies in good condition. P(FR) and TU(FR) can take various values according to design of the display device. Therefore, the display device is driven in various operation conditions to perform measurement and suitable values may be selected and used according to frame frequencies.

The invention has been explained based on the preferred embodiment as the above, and the invention is not limited to the embodiment. The configurations and structures of the display device and the display element as well as steps of the drive method of the display element and the display device explained in the embodiment are just shown as examples and can be changed appropriately.

For example, it is preferable to apply a configuration which the drive circuit 11 included in the display element 10 has a transistor (first transistor $TR_1$) connected to the second node $ND_2$. In the first transistor $TR_1$, a second node initialization voltage $V_{SS}$ is applied to one source/drain region, and the other source/drain region is connected to the second node $ND_2$. A signal from a first transistor control circuit 104 is applied to a gate electrode of the first transistor $TR_1$ through a first transistor control line AZ1 to control the ON/OFF state of the first transistor $TR_1$. According to this, the potential of the second node $ND_2$ can be set.

Figure 26:
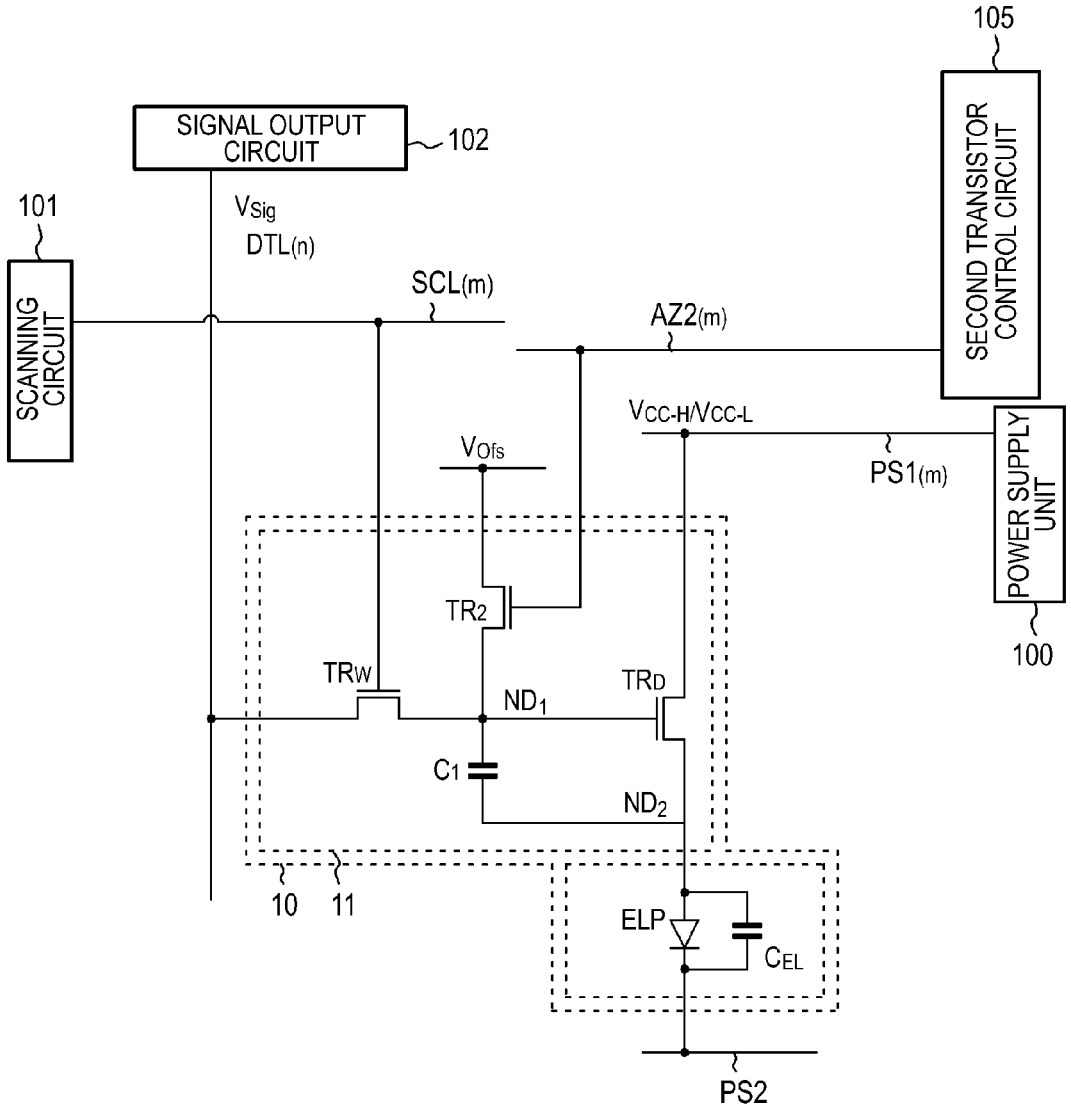
FIG. 26 is an equivalent circuit diagram of the display element including the drive circuit.
Figure 27:
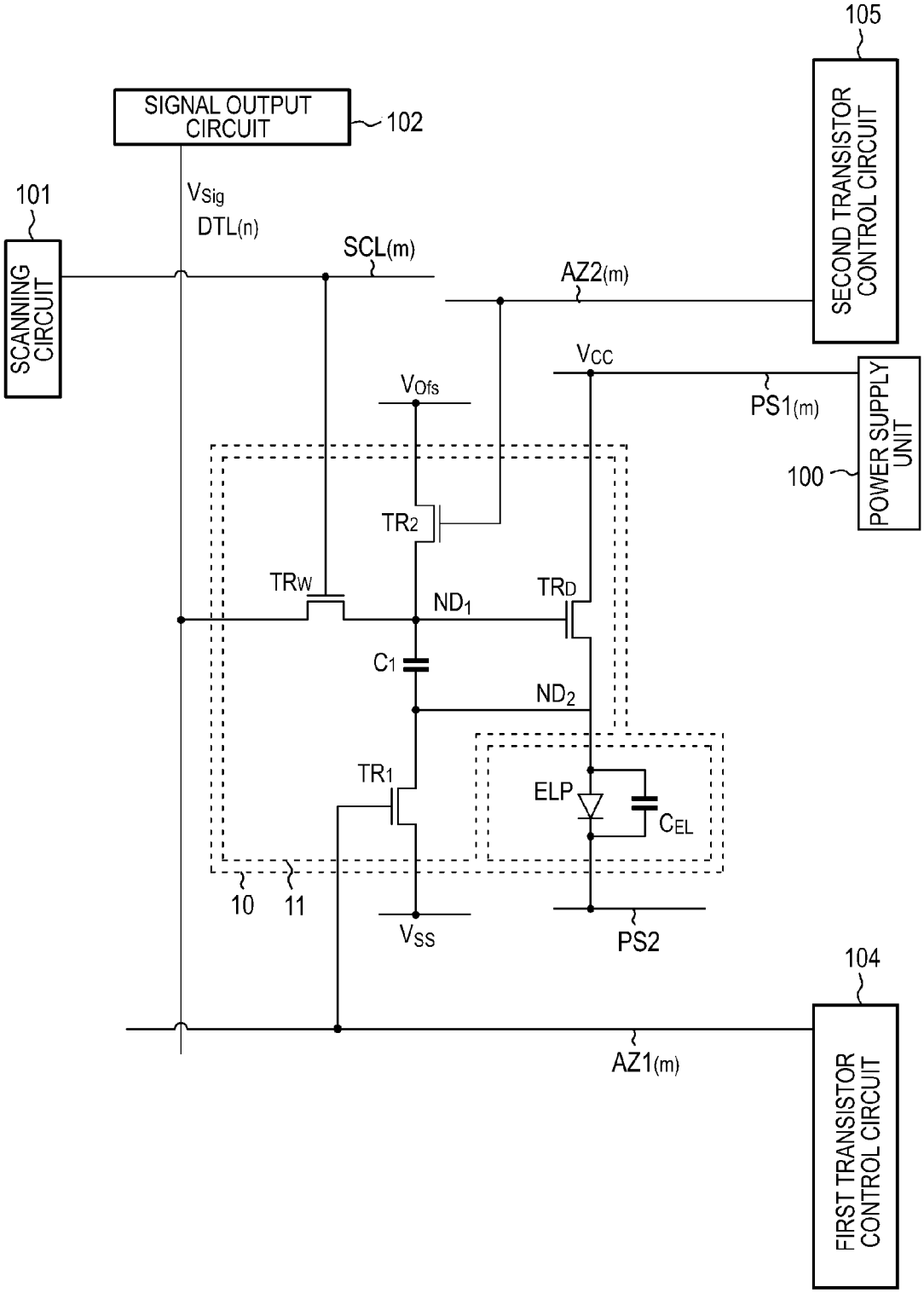
FIG. 27 is an equivalent circuit diagram of the display element including the drive circuit.

Additionally, it is preferable to apply a configuration in which the drive circuit 11 included in the display element 10 has a transistor (second transistor $TR_2$) connected to the first node $ND_1$ as shown in FIG. 26. In the second transistor $TR_2$, the first node initialization voltage $V_{ofs}$ is applied to one source/drain region, and the other source/drain region is connected to the first node $ND_1$. A signal from a second transistor control circuit 105 is applied to a gate electrode of the second transistor $TR_2$ through a second transistor control line AZ2 to control the ON/OFF state of the second transistor $TR_2$. According to this, the potential of the first node $ND_1$ can be set.

Furthermore, it is also possible to apply a configuration in which the drive circuit 11 included in the display element 10 has both the first transistor $TR_1$ and the second transistor $TR_2$. It is also preferable to apply a configuration in which another transistor is included in addition to the above transistors.

In the embodiment, the explanation has been made assuming that the drive transistor $TR_D$ is an n-channel transistor. In the case where the drive transistor $TR_D$ is a p-channel transistor, it is preferable to perform wire connection in which the anode electrode and the cathode electrode of the light emitting portion are replaced with each other. In the configuration, the direction in which the drain current flows is changed, therefore, the voltage value to be applied to the feeding line and the like may be suitably changed.

The present application contains subject matter related to that disclosed in Japanese Priority Patent Application JP 2009-133606 filed in the Japan Patent Office on Jun. 3, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a plurality of pixel circuits, each of the plurality of pixel circuits including a light emitting element, a write transistor, a drive transistor and a capacitor, wherein the drive transistor is configured to, in a threshold voltage cancel processing period, flow a correction current to the capacitor while the write transistor is supplying a reference potential from a video signal line, and wherein a length of the threshold voltage cancel processing period is set so as to be shorter as a frame frequency becomes higher wherein the length of the threshold voltage cancel processing period is adjusted by changing a width of a scanning pulse corresponding to the threshold voltage cancel processing period without changing a width of a scanning pulse corresponding to the video signal writing period.

2. An electronic apparatus comprising the display device of claim 1.

3. A display device comprising:

at least one sub-pixel that includes a light emitting element, a write transistor, a drive transistor and a capacitor;

a control circuit configured to:

perform a threshold voltage cancel processing operation comprising causing the drive transistor to flow a correction current to the capacitor while the write transistor is supplying a reference potential from a video signal line, and adjust a per-frame-period aggregate amount of time that the threshold voltage cancel processing operation is performed based on a change in frame frequency without affecting a duration of a video signal writing operation.

4. The display device of claim 3, wherein the control circuit is configured to perform the threshold voltage cancel processing operation multiple times each frame period, and the per-frame-period aggregate amount of time that the threshold voltage cancel processing operation is performed is adjusted by at least one of:

adjusting durations of individual performances of the threshold voltage cancel processing operation in the frame period; and adjusting a number of times the threshold voltage cancel processing operation is performed in the frame period.

5. The display device of claim 4, wherein the per-frame-period aggregate amount of time that the threshold voltage cancel processing operation is performed is adjusted by at least adjusting a number of times the threshold voltage cancel processing operation is performed in the frame period.

6. The display device of claim 4, wherein the per-frame-period aggregate amount of time that the threshold voltage cancel processing operation is performed is adjusted by a combination of:

adjusting durations of individual performances of the threshold voltage cancel processing operation in the frame period; and adjusting a number of times the threshold voltage cancel processing operation is performed in the frame period.

7. An electronic apparatus comprising the display device of claim 3.

8. A method of operating a display device that includes at least one sub-pixel that includes a light emitting element, a write transistor, a drive transistor and a capacitor, the method comprising:

performing a threshold voltage cancel processing operation comprising causing the drive transistor to flow a correction current to the capacitor while the write transistor is supplying a reference potential from a video signal line, and adjust a per-frame-period aggregate amount of time that the threshold voltage cancel processing operation is performed based on a change in frame frequency without affecting a duration of a video signal writing operation.

9. The method of claim 8, further comprising:

performing the threshold voltage cancel processing operation multiple times each frame period, wherein the per-frame-period aggregate amount of time that the threshold voltage cancel processing operation is performed is adjusted by at least one of:

adjusting durations of individual performances of the threshold voltage cancel processing operation in the frame period; and adjusting a number of times the threshold voltage cancel processing operation is performed in the frame period.

10. The method of claim 9, wherein the per-frame-period aggregate amount of time that the threshold voltage cancel processing operation is performed is adjusted by at least adjusting a number of times the threshold voltage cancel processing operation is performed in the frame period.

11. The method of claim 9, wherein the per-frame-period aggregate amount of time that the threshold voltage cancel processing operation is performed is adjusted by a combination of:

adjusting durations of individual performances of the threshold voltage cancel processing operation in the frame period; and adjusting a number of times the threshold voltage cancel processing operation is performed in the frame period.

* * * * *